US008985743B2

(12) United States Patent
Sasaki

(10) Patent No.: US 8,985,743 B2
(45) Date of Patent: Mar. 24, 2015

(54) PRINTING FLUID SUPPLY DEVICE AND PRINTING FLUID CARTRIDGE

(71) Applicant: Toyonori Sasaki, Anjo (JP)

(72) Inventor: Toyonori Sasaki, Anjo (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/081,494

(22) Filed: Nov. 15, 2013

(65) Prior Publication Data

US 2014/0168324 A1 Jun. 19, 2014

(30) Foreign Application Priority Data

Dec. 14, 2012 (JP) ..... 2012-272971

(51) Int. Cl.
*B41J 2/14* (2006.01)
*B41J 2/175* (2006.01)
*B41J 29/393* (2006.01)

(52) U.S. Cl.
CPC ..... *B41J 2/17523* (2013.01); *B41J 2/1752* (2013.01)
USPC ..... 347/49; 347/86; 347/19

(58) Field of Classification Search
USPC ..... 347/19, 49, 50, 85, 86
See application file for complete search history.

(56) References Cited

U.S. PATENT DOCUMENTS

| | | | | |
|---|---|---|---|---|
| 6,832,830 | B2 | 12/2004 | Seino et al. | |
| 7,278,721 | B2 * | 10/2007 | Shimizu et al. | 347/86 |
| 7,484,825 | B2 * | 2/2009 | Asauchi | 347/19 |
| 7,651,208 | B2 * | 1/2010 | Matsumoto | 347/86 |
| 2007/0222838 | A1 | 9/2007 | Wanibe | |

FOREIGN PATENT DOCUMENTS

| | | | |
|---|---|---|---|
| JP | 2007-237657 | A | 9/2007 |
| JP | 4281815 | B2 | 6/2009 |

* cited by examiner

*Primary Examiner* — Anh T. N. Vo
(74) *Attorney, Agent, or Firm* — Baker Botts L.L.P.

(57) ABSTRACT

A printing fluid cartridge includes a cartridge body, an electric interface, and a support member at which the electric interface is provided. The cartridge body is configured to hold the support member, such that the support member is movable relative to the cartridge body. A cartridge mounting portion includes a sandwiching portion configured to sandwich the support member.

19 Claims, 12 Drawing Sheets

PRINTING FLUID SUPPLY DEVICE AND PRINTING FLUID CARTRIDGE

CROSS REFERENCE TO RELATED APPLICATION

The present application claims priority to and the benefit of Japanese Application No. 2012-272971, which was filed on Dec. 14, 2012, the disclosure of which is incorporated herein by reference in its entirety.

BACKGROUND OF THE INVENTION

1. Field of the Invention

The present invention relates to a printing fluid cartridge configured to be mounted to a cartridge mounting portion and to a printing fluid supply device comprising the printing fluid cartridge and the cartridge mounting portion.

2. Description of Related Art

An image recording apparatus that uses ink to record an image on a sheet of recording paper has been conventionally known. The image recording apparatus has a recording head of an inkjet recording method and selectively ejects ink droplets from nozzles of the recording head toward the sheet of recording paper. When the ink droplets land on the sheet of recording paper, a desired image is recorded on the recoding paper. The image recording apparatus has an ink cartridge that stores ink to be supplied to the recording head. The ink cartridge can be removably mounted to a mounting portion of the image recording apparatus. The ink cartridge may be equipped with a circuit board on which an IC chip is mounted. The IC chip stores data about the color and material of ink stored in the ink cartridge, a remaining amount of ink, a maintenance state, and the like. Contact terminals on the circuit board are brought into electric contact with connection terminals provided at the mounting portion when the ink cartridge is mounted to the mounting portion, enabling the data stored in the IC chip to be read out. Such an image recording apparatus is disclosed in JP-A-2007-237657 for example.

When an ink cartridge is mounted to a mounting portion, an ink supply tube of the mounting portion is inserted into an ink supply portion of the ink cartridge. Therefore, the ink cartridge needs to be accurately positioned such that the ink supply portion is aligned with the ink supply tube. The ink cartridge also needs to be accurately positioned such that the contact terminals on the circuit board of the ink cartridge are aligned with the connection terminals of the mounting portion for the contact terminals to come into contact with the connection terminals. Nevertheless, it may be difficult to achieve high dimensional precision with which the ink supply portion and ink supply tube are aligned and the contact terminals and connection terminals are aligned.

SUMMARY OF THE INVENTION

Therefore, a need has arisen for a printing fluid supply device and a printing fluid cartridge, which overcome these and other shortcomings of the related art. A technical advantage of the present invention is that a stable electric contact between an electric interface and a contact is achieved.

According to an embodiment of the present invention, a printing fluid supply device comprises: a cartridge mounting portion; and a printing fluid cartridge configured to be inserted into the cartridge mounting portion in an insertion direction which is aligned with a first direction, wherein the printing fluid cartridge comprises: a cartridge body comprising a printing fluid chamber configured to store printing fluid therein; a printing fluid supply portion provided at the cartridge body and extending along the first direction, wherein the printing fluid supply portion is in fluid communication with the printing fluid chamber; an electric interface; and a support member comprising a support surface facing in a first sub direction and a rear surface positioned opposite the support surface and facing in a second sub direction opposite the first sub direction, wherein the first sub direction and the second sub direction constitute a second direction which is perpendicular to the first direction, wherein the electric interface is provided at the support surface, and the cartridge mounting portion comprises: a connection portion configured to be connected to the printing fluid supply portion and allow the printing fluid to flow out of the printing fluid chamber through the printing fluid supply portion; and a sandwiching portion comprising a first sandwiching piece and a second sandwiching piece, wherein the first sandwiching piece and the second sandwiching piece are spaced away from each other in the second direction, and configured to sandwich, in the second direction, the support member of the printing fluid cartridge inserted into the cartridge mounting portion, wherein the first sandwiching piece comprises a surface facing in the second sub direction, wherein the surface of the first sandwiching piece supports a contact configured to contact the electric interface, one of the first sandwiching piece and second sandwiching piece comprises a guide surface configured to contact the support member and guide the support member in the second direction during insertion of the printing fluid cartridge into the cartridge mounting portion, and the cartridge body has a first space and a second space formed therein, wherein the first space is opened in the insertion direction and the first sandwiching piece is configured to be inserted into the first space, and the second space is opened in the insertion direction and the second sandwiching piece is configured to be inserted into the second space, wherein the support surface of the support member faces the first space and the rear surface of the support member faces the second space, wherein the cartridge body is configured to hold the support member such that the support member is movable relative to the cartridge body in the second direction.

According to another embodiment of the present invention, a printing fluid cartridge configured to be inserted into a cartridge mounting portion in an insertion direction which is aligned with a first direction, the cartridge mounting portion comprising a connection portion, a first sandwiching piece supporting a contact, and a second sandwiching piece, the cartridge comprises a cartridge body comprising a printing fluid chamber configured to store printing fluid therein; a printing fluid supply portion provided at the cartridge body and extending along the first direction, wherein the printing fluid supply portion is configured to be connected to the connection portion, such that the printing fluid is allowed to flow out of the printing fluid chamber through the printing fluid supply portion; an electric interface configured to contact the contact supported by the first sandwiching piece; and a support member comprising a support surface facing in a first sub direction and a rear surface positioned opposite the support surface and facing in a second sub direction opposite the first sub direction, wherein the first sub direction and the second sub direction constitute a second direction which is perpendicular to the first direction, wherein the electric interface is provided at the support surface, wherein the cartridge body has a first space and a second space formed therein, wherein the first space is opened in the insertion direction so as to receive the first sandwiching piece therein, and the second space is opened in the insertion direction so as to receiver the second sandwiching piece therein, wherein the support surface of the support member faces the first space and the rear surface of the support member faces the second space, wherein the cartridge body is configured to hold the support member such that the support member is movable relative to the cartridge body in the second direction.

According to another embodiment of the present invention, a printing fluid cartridge comprises a cartridge body comprising a printing fluid chamber configured to store printing fluid therein; an electric interface; a support member comprising a support surface facing in a first sub direction and a rear surface positioned opposite the support surface and facing in a second sub direction opposite the first sub direction, wherein the electric interface is provided at the support surface; and a printing fluid flow path having an end which is opened to the outside of the cartridge body, wherein the printing fluid flow path extends from the end of the printing fluid flow path in a third sub direction toward the interior of the cartridge body, wherein the printing fluid flow path is configured to allow the printing fluid out of the printing fluid chamber therethrough, wherein the cartridge body has a first space and a second space formed therein, wherein the first space is opened in a fourth sub direction opposite the third sub direction, and the second space is opened in the fourth sub direction, wherein the third sub direction and the fourth sub direction constitute a first direction and the first sub direction and the second sub direction constitute a second direction which is perpendicular to the first direction, wherein the support surface of the support member faces the first space and the rear surface of the support member faces the second space, wherein the cartridge body is configured to hold the support member such that the support member is movable relative to the cartridge body in the second direction.

With this configuration, a stable electric contact between the electric interface and the contact may be achieved.

Other objects, features, and advantages will be apparent to persons of ordinary skill in the art from the following detained description of the invention and the accompanying drawings.

BRIEF DESCRIPTION OF THE DRAWINGS

For a more complete understanding of the present invention, needs satisfied thereby, and the objects, features, and advantages thereof, reference now is made to the following description taken in connection with the accompanying drawings.

DETAILED DESCRIPTION OF EMBODIMENTS OF THE INVENTION

Embodiments of the present invention, and their features and advantages, may be understood by referring to FIGS. 1-12, like numerals being used for like corresponding parts in the various drawings. In the embodiments below, a depth direction (front-rear direction) 53 is an example of a first direction, a height direction (up-down direction) 52 is an example of a second direction, and a width direction (left-right direction) 51 is an example of a third direction.

[Printer 10]

Figure 1:
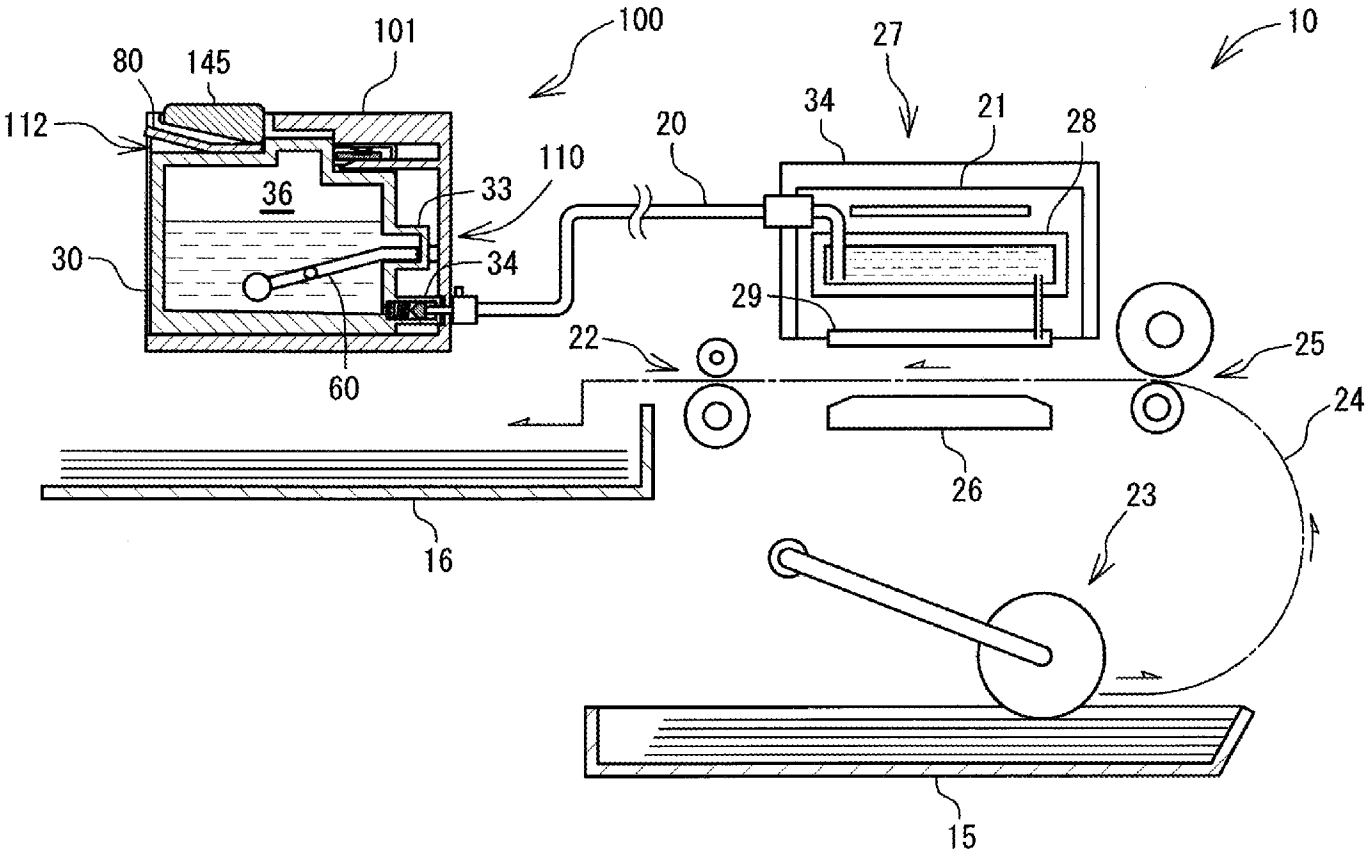
FIG. 1 is a schematic, cross-sectional view of a printer comprising an ink supply device according to an embodiment.

Referring to FIG. 1, a printer 10 is configured to record an image by selectively ejecting ink droplets to a sheet of recording paper, using an inkjet recording method. The printer 10 comprises an ink supply device 100 as an example of the printing fluid supply device. The ink supply device 100 comprises a cartridge mounting portion 110 and an ink cartridge 30 as an example of the printing fluid cartridge. The ink cartridge 30 is configured to be mounted to the cartridge mounting portion 110. The cartridge mounting portion 110 has an opening 112 formed therein. The ink cartridge 30 is configured to be inserted into the cartridge mounting portion 110 and be removed from the cartridge mounting portion 110 through the opening 112.

The ink cartridge 30 is configured to store ink to be used by the printer 10. The printer 10 comprises a recording head 21 having nozzles 29 formed therein, an ink tube 20, and a sub tank 28. The ink cartridge 30 and the recording head 21 are connected via the ink tube 20 when the ink cartridge 30 is mounted to the cartridge mounting portion 110. The sub-tank 28 is provided in the recording head 21. The sub-tank 28 is configured to temporarily store ink that is supplied via the ink tube 20. The recording head 21 is configured to selectively eject, from the nozzles 29, the ink supplied from the sub-tank 28, using the inkjet recording method.

The printer 10 comprises a paper supply tray 15, a paper supply roller 23, a conveying roller pair 25, a platen 26, a discharge roller pair 22, and a discharge tray 16. A conveying path 24 is formed from the paper supply tray 15 to the discharge tray 16, and the conveying path 24 extends through the nip of the conveying roller pair 25, between the platen 26 and the recording head 21, and through the nip of the discharge tray 16. A sheet of recording paper supplied by the paper supply roller 23 from the paper supply tray 15 to the conveying path 24 is conveyed onto the platen 26 by the conveying roller pair 25. The recording head 21 selectively ejects ink to the sheet of recording paper passing over the platen 26. Thus, an image is recorded on the sheet of recording paper. The recording paper that has passed the platen 26 is discharged by the discharge roller pair 22 to the discharge tray 16 provided at the downstream end of the conveying path 24.

[Ink Cartridge 30]

Figure 2:
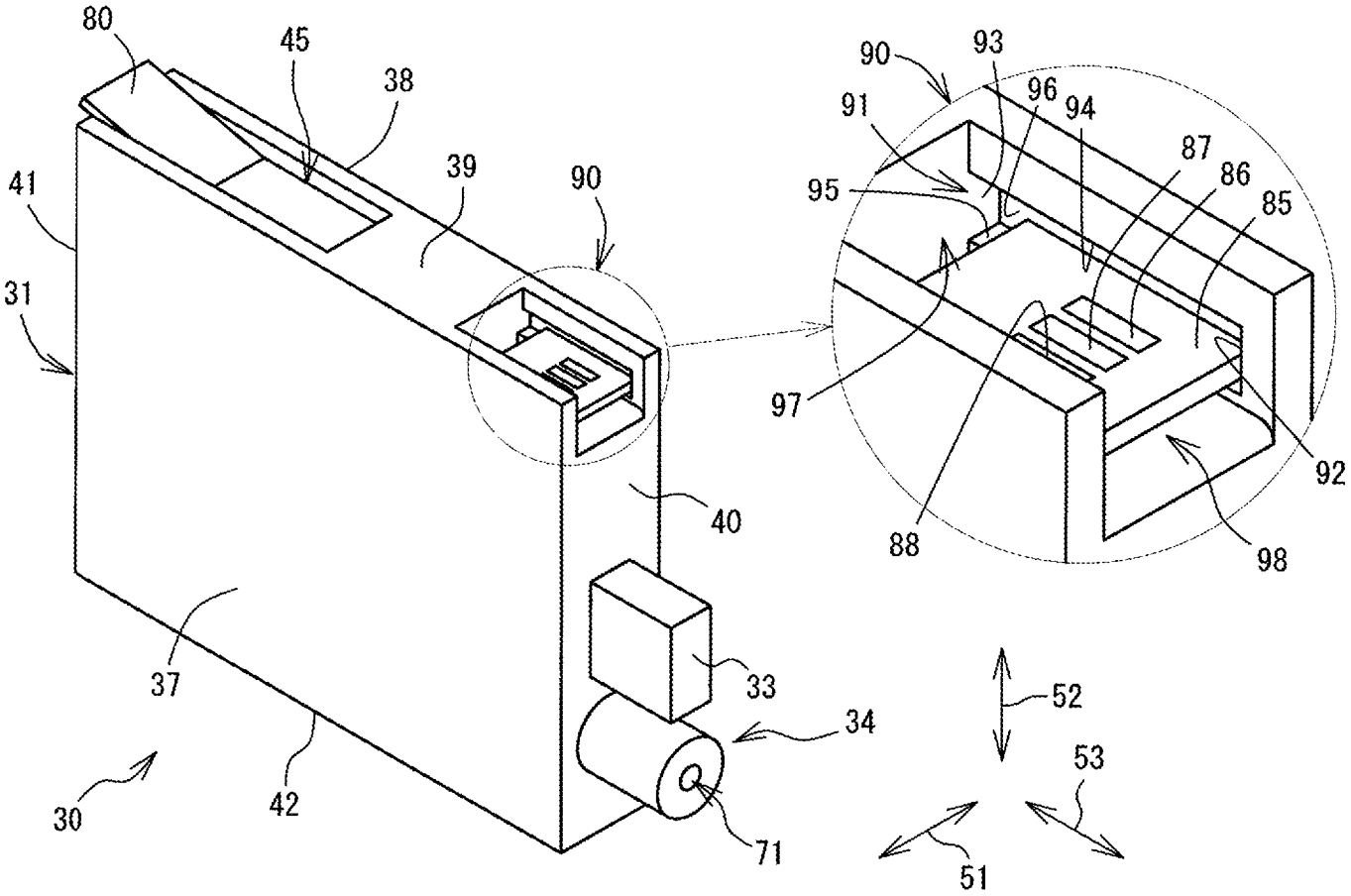
FIG. 2 is a perspective view of an ink cartridge according to an embodiment.
Figure 3:
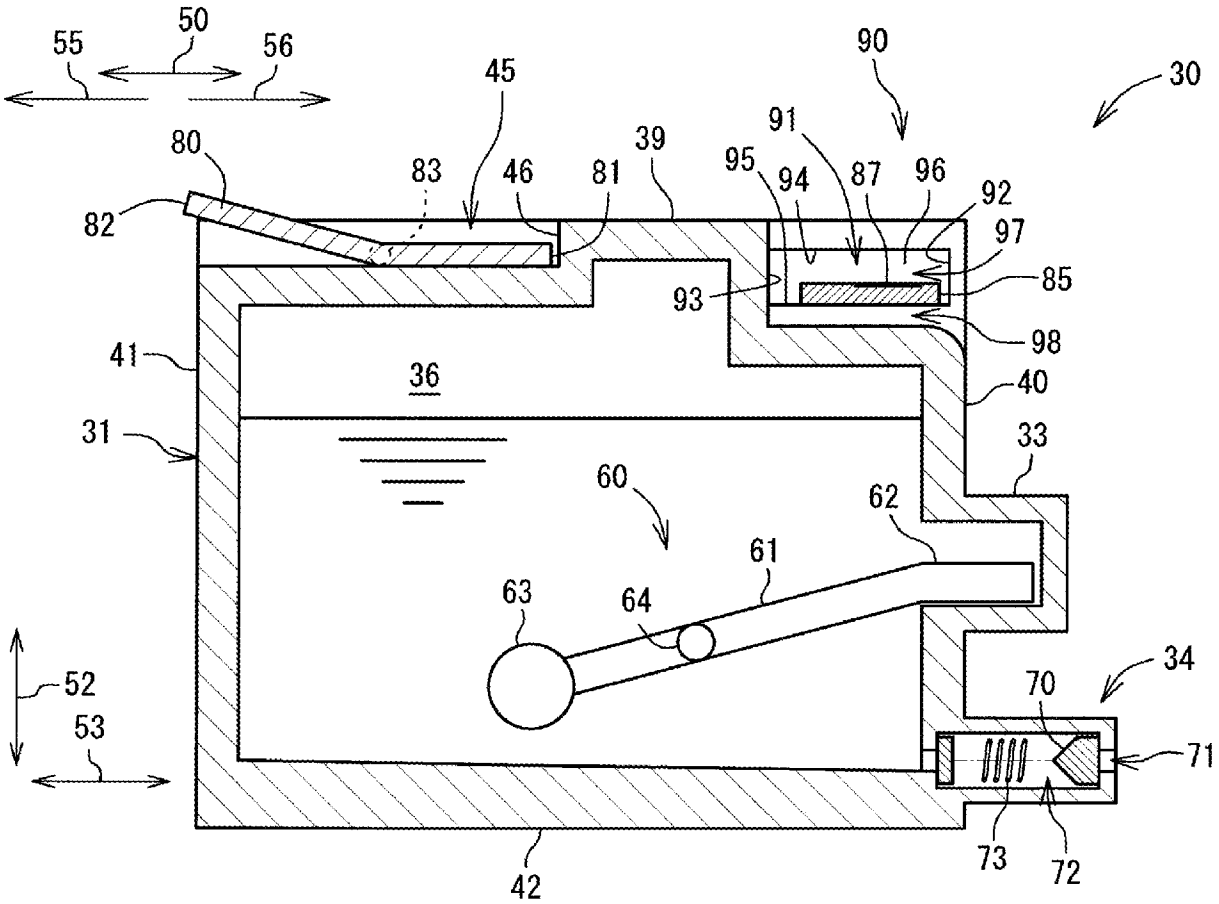
FIG. 3 is a vertical, cross-sectional view of the ink cartridge.

Referring to FIGS. 2 and 3, the ink cartridge 30 is a container configured to store ink therein. The ink cartridge 30 comprises a main body 31, and the main body 31 comprises an outer case defining the most of the exterior of the ink cartridge 30. The main body 31 comprises an ink chamber 36 formed directly inside the outer case. In another embodiment, the main body 31 may comprise an internal frame positioned within the outer case, and the ink chamber 36 may be formed in the internal frame. The ink chamber 36 is configured to store ink therein. The ink cartridge 30 is an example of a printing fluid cartridge and the ink chamber 36 is an example of a printing fluid chamber.

The ink cartridge 30 is configured to be inserted into and removed from the cartridge mounting portion 110 in a direction indicated by an arrow 50 (see FIG. 3, the direction is named an insertion/removal direction 50) while the ink cartridge 30 is in an upright position, as shown in FIGS. 2 and 3, with the top surface of the ink cartridge 30 facing upward and the bottom surface of the ink cartridge 30 facing downward. The ink cartridge 30 is in the upright position when ink cartridge 30 is mounted to the cartridge mounting portion 110 in a mounted position. The Ink cartridge 30 is configured to be inserted into the cartridge mounting portion 110 in an insertion direction 56 and removed from the cartridge mounting portion 110 in a removal direction 55. The insertion/removal direction 50 is a combination of insertion direction 56 and removal direction 55. In this embodiment, the insertion direction 56, removal direction 55, and insertion/removal direction 50 are horizontal directions. In another embodiment, the insertion direction 56, removal direction 55, and insertion/removal direction 50 may be inclined relative to a horizontal plane. For example, when the insertion/removal direction 50 is the vertical direction, a front face of the ink cartridge 30 in the insertion direction 50 faces downward. The insertion/removal direction 50 is an example of a first direction, the removal direction is an example of a third sub direction, and the insertion direction 56 is an example of a fourth sub direction The main body 31 of ink cartridge 30 has a three-dimensional shape formed with planar surfaces or curved surfaces, e.g., a substantially parallelepiped shape. The main body 31 has a width in the width direction (left-right direction) 51, a height in a height direction (up-down direction) 52, and a depth in a depth direction (front-rear direction) 53. The width direction (left-right direction) 51, height direction (up-down direction) 52, and depth direction (front-rear direction) 53 are perpendicular to each other. The width of the main body 31 is less than the height and the depth of the main body 31. When the ink cartridge 30 is in the mounted position, i.e., in the upright position, the width direction (left-right direction) 51 is parallel with a horizontal plane, the depth direction (front-rear direction) 53 also is parallel with the horizontal plane, and height direction 52 is parallel with the vertical direction, i.e., the gravitational direction. When the ink cartridge 30 is inserted into/removed from the cartridge mounting portion 110, the depth direction 53 is parallel with the insertion/removal direction 50, and the width direction and height direction 52 are perpendicular to the insertion/removal direction 50. The height direction (up-down direction), i.e., the vertical direction or the gravitational direction is a combination of an upward direction and a downward direction. The upward direction is an example of a first sub direction, and the downward direction is an example of a second sub direction.

Referring to FIGS. 2 and 3, the main body 31 comprises a front wall 40 and a rear wall 42. The front wall 40 is disposed on a front side of the main body 31 with respect to the insertion direction 56 and the rear wall 42 is disposed on a rear side of the main body 31 with respect to the insertion direction 56 when ink cartridge 30 is inserted into cartridge mounting portion 110. The font wall 40 and the rear wall 42 at least partly overlap in depth direction 53. The front wall 40 and the rear wall 42 at least partly overlap in the insertion/removal direction 50 when the ink cartridge 30 is inserted or removed into/from the cartridge mounting portion 110. The main body 31 comprises side walls 37, 38, each extending in the insertion/removal direction 50 and connected to the front wall 40 and rear wall the 42. The side walls 37, 38 at least partly overlap in the width direction (left-right direction) 51. The main body 31 comprises a top wall 39 connected to the upper ends of front wall 40, rear wall 42, and the side walls 37, 38. The main body 31 comprises a bottom wall 41 connected to the lower ends of front wall 40, rear wall 42, and the side walls. The top wall 39 and the bottom wall 41 at least partly overlap in height direction (up-down direction) 52.

The outer faces of the side walls 37 and 38 correspond to side surfaces of the ink cartridge 30. The outer face of the front wall 40 corresponds to a front face of the ink cartridge 30. The outer face of the rear wall 41 corresponds to a rear face of the ink cartridge 30. The outer face of the top wall 39 corresponds to the top face of the ink cartridge 30. The outer face of the bottom wall 42 corresponds to the bottom face of the ink cartridge 30. The rear wall 41 is a wall that is visible when the main body 31 of the ink cartridge 30 is viewed in the insertion direction 56.

Referring to FIGS. 2 and 3, the main body 31 comprises an ink amount detection portion 33 provided at the middle of the front wall 40 of the main body 31 in the height direction (up-down direction) 52. The ink amount detection portion 33 has a rectangular parallelepiped box shape extending from the front wall 40 and the inside of the ink amount detection portion 33 is in fluid communication with the ink chamber 36. The ink amount detection portion 33 has a pair of walls made of a translucent, e.g., transparent or semi-transparent resin that allows light, e.g., infrared light or visible light, emitted from an optical sensor 114 (see FIG. 4) to pass therethrough in a direction, i.e., the width direction (left-right direction) 51 in this embodiment, which is perpendicular to the insertion/removal direction 50. In other words, the walls constituting the ink amount detection portion 33 allows light to pass therethrough in the width direction (left-right direction) 51.

Referring to FIG. 3, the ink cartridge 30 comprises a sensor arm 60 positioned in the ink chamber 36. The sensor arm 60 comprises an arm 61, an indicator portion 62, which has a plate shape, at a first end of the arm 61, and a float portion 63 at a second end of the arm 61. The indicator portion 62 of the sensor arm 60 is positioned between the right and left walls of the ink amount detection portion 33 in the width direction (left-right direction) 51. The indicator portion 62 is made of an opaque material. The sensor arm 60 is pivotally supported by a supporting shaft 64 extending in the width direction 51 in the ink chamber 36. The sensor arm 60 is configured to pivot as the amount of ink stored in the ink chamber 36 changes.

When the sensor arm 60 pivots, the indicator portion 62 moves between a lower position located at a lower portion of the ink amount detection portion 33 and an upper position located at an upper position of the ink amount detection portion 33. When the indicator portion 62 is in the upper position, the ink amount detection portion 33 allows the infrared light emitted from the optical sensor 114 to pass therethough, not being blocked by the indicator portion 62. When the indicator portion 62 is in the lower position, the ink amount detection portion 33 prevents the infrared light emitted from the optical sensor 114 from passing therethrough or attenuates the light by being blocked by the indicator portion 62. It can be determined that the amount of ink stored in the ink chamber 36 has become less than a predetermined amount by detecting the light transmission state of the ink amount detection portion 33.

The ink cartridge 30 comprises an ink supply portion 34 provided at the front wall 40 of the main body 31 below the ink amount detection portion 33. The ink supply portion 34 has a cylindrical outer shape and extends from the front wall 40 outwardly (that is, in the insertion direction 56) along the insertion/removal direction 50. The ink supply portion 34 comprises an end in the insertion direction 56 and has an ink supply opening 71 formed at the end of the ink supply portion 34. The ink supply portion 34 is an example of a printing fluid supply portion provided at the main body 31 and extending along the depth direction 53 and along the insertion/removal direction 50.

The ink supply portion 34 has an ink flow path 72 formed therein, and the ink flow path 72 extends in the insertion/removal direction 50 from the ink supply opening 71 to ink chamber 36. The ink flow path 72 is an example of a printing fluid flow path that has an end, i.e., the ink supply opening 71 that is opened to the outside of the main body 31 and extends from the ink supply opening 71 to the interior of the main body 31 in the removal direction 55 of the insertion/removal direction 50. The ink supply portion 34 comprises an ink supply valve 70 and a coil spring 73 positioned in the ink flow path 72. The ink supply valve 70 is configured to move so as to selectively open and close the ink supply opening 71. The coil spring 73 is configured to bias the ink supply valve 70 toward the ink supply opening 71 such that the ink supply valve 70 closes the ink supply opening 71. When the ink cartridge 30 is mounted to the cartridge mounting portion 110, an ink needle 117 (see FIG. 4) provided in the cartridge mounting portion 110 is inserted into the ink supply opening 71, and contacts and moves the ink supply valve 70 away from the ink supply opening 71 against the biasing force of the coil spring 73. Thus, ink stored in the ink chamber 36 flows through the ink flow path 72 to the ink needle 117.

The ink supply portion 34 is not necessarily configured such that the ink supply opening 71 is selectively closed and opened by the ink supply valve 70. In another embodiment, the ink supply opening 71 may be covered by a film or rubber, and when the ink cartridge 30 is mounted to the cartridge mounting portion 110, the ink needle 117 may penetrates through the film or rubber for the ink supply opening 71 to be opened. Although not shown in the drawings, the main body 31 may have a communication opening to the atmosphere through air can pass between the ink chamber 36 and the outside of the ink cartridge 30.

The main body 31 comprises a lock portion 45 at the top wall 39. The lock portion 45 has a groove extending in the depth direction from the middle of the top wall 39 with respect to the depth direction 53 up to the rear wall 41. The lock portion 45 comprises, at the end of the groove in the insertion direction 56, a lock surface 46 that extends in the width direction (left-right direction) 51 and height direction (up-down direction) 52 of the ink cartridge 30. The lock surface 46 is configured to contact a lock member 145 of the cartridge mounting portion 110 (see FIG. 4) when the ink cartridge 30 is mounted to the cartridge mounting portion 110. The lock surface 46 receives external force in a direction opposite to a direction in which the ink cartridge 30 is biased in the removal direction 55 when the ink cartridge 30 is mounted to the cartridge mounting portion 110, i.e., receives force from the lock member 145 in this embodiment. The end of the groove in the removal direction 55 is open to the outside of the main body 31.

The ink cartridge 30 comprises a pivot member 80 at the lock portion 45. The pivot member 80 has, for example, a bent flat plate shape and is disposed such that its longitudinal direction is aligned with the depth direction 53. The pivot member 80 has an axis 83 at a position at which the pivot member 80 is bent. The pivot member 80 is configured to pivot about the axis 83. The pivot member 80 comprises a front end 81 and a rear end 82 with respect to the depth direction 53, and the front end 81 of the pivot member 80 extends from the axis 83 toward the lock surface 46 and the rear end 82 of the pivot member 80 extends from the axis 83 toward the rear wall 41.

When the pivot member 80 pivots to a position in which the front end 81 is in the uppermost position, the front end 81 extends outwardly beyond the top wall 39 of the main body 31. When the front end 81 of the pivot member 80 is pressed downward, the pivot member 80 pivots clockwise as viewed in FIG. 3. When the pivot member 80 pivots to the clockwise end, the front end 81 is positioned close to the lower end of the lock surface 46. The pivot member 80 may be formed integrally with the main body 31. The pivot member 80 may be biased clockwise by a coil spring (not shown) or may pivot due to its own weight in one direction.

[IC Board 85, IC Board Holding Portion 90]

Referring to FIGS. 2 and 3, the ink cartridge 30 comprises an IC board 85, and the main body 30 comprises an IC board holding portion 90 configured to hold the IC board 85. The IC board holding portion 90 is positioned at the top wall 39 of the main body 31 at a position which is closer to the front wall 40 than the lock portion 45 is. The IC board holding portion 90 has a space formed by cutting out a corner between the top wall 39 and front wall 40. The space is opened to the outside of the main body 31 in the insertion direction 56 and in the upward direction of the height direction (up-down direction) 52. The space is closed in the removal direction 55 by an outer surface of the main body 31, which outer surface faces in the insertion direction 56. The space is also closed in the downward direction of the height direction 52 by an outer surface of the main body 31, which outer surface faces in the upward direction of the height direction (up-down direction) 52. The space is also closed in the width direction (left-right direction) 51 by inner surfaces of the side walls 37 and 38.

A groove 91 is formed in the inner surface of the side wall 38, and the groove 91 extends in the depth direction 53. The groove 91 in this embodiment has a rectangular parallelepiped shape. That is, the groove 91 has a rectangular cross section along the width direction 51 and height direction 52 and also has a rectangular cross section along the height direction 52 and depth direction 53. The groove 91 is defined by a front wall surface 92, a rear wall surface 93, top wall surface 94, a bottom wall surface 95, and a side wall surface 96. The front wall surface 92 extends in the width direction (left-right direction) 51 and the height direction (up-down direction) 52. The rear wall surface 93 extends in the width direction (left-right direction) 51 and the height direction (up-down direction) 52. The top wall surface 94 extends in the width direction (left-right direction) 51 and the depth direction (front-rear direction) 53. The bottom wall surface 95 extends in the width direction (left-right direction) 51 and the depth direction (front-rear direction) 53. The side wall surface 96 extends in the height direction 52 and the depth direction 53. In this embodiment, the rear wall surface 93 is the same plane as the outer surface of the main body 31, which outer surface faces in the insertion direction 56 and closes the above-described space of the IC board holding portion 90 in the removal direction 55.

Although not illustrated, another groove is also formed at a position opposite to the groove 91 in the inner surface of the side wall 37. That is, a pair of grooves, which extend in the depth direction 53 and face each other in the width direction 51, is formed in the IC board holding portion 90. The IC board 85 has substantially a rectangular parallelepiped shape. The ends of the IC board 85 in the width direction 51 are inserted into the grooves, i.e., the groove 91 and the corresponding groove in the inner surface of the side wall 37, respectively. A distance between the side wall surface 96 of the groove 91 and the inner surface of the side wall 37 is less than the width of the IC board 85 in the width direction 51. The distance between the side wall surface of the groove formed in the side wall 37 and the inner surface of the side wall 38 is less than the width of the IC board 85 in the width direction 51. Accordingly, the IC board 85 does not come off the grooves. In this embodiment, the grooves formed in the inner surfaces of the side walls 37 and 38 have an identical shape, so the following description will focus on the groove 91.

The IC board 85 comprises a top surface facing in the upward direction and a rear surface positioned opposite the top surface and facing in the downward direction. The ink cartridge 30 comprises electrodes 86, 87, and 88 provided at the top surface of the IC board 85. At the top surface of the IC board 85, the electrodes 86, 87, and 88 each extend in the depth direction 53 and are spaced away in the width direction 51. The electrodes 86, 87, and 88 are examples of an electric interface, the IC board 85 is an example of a support member, and the top surface of the IC board 85 is an example of a support surface. The electrodes 86, 87, and 88 are, for example, a HOT electrode, a GND electrode, and a signal electrode. An IC chip (not illustrated), which is electrically connected to the electrodes 86, 87 and 88, is mounted to the IC board 85. The IC chip is a semiconductor integrated circuit configured to store data indicating information about the ink cartridge 30 such as, for example, a lot number, a date of manufacturing, and an ink color. The data can be read out of the IC chip by the printer 10 when the ink cartridge 30 is mounted to the cartridge mounting portion 110.

The front wall surface 92 and rear wall surface 93, which define the ends of the groove 91 in the depth direction (front-rear direction) 53, face each other in the depth direction (front-rear direction) 53. The distance between the front wall surface 92 and the rear wall surface 93 in the depth direction (front-rear direction) 53 (that is, the dimension of the groove 91 in the depth direction (front-rear direction) 53) is greater than the dimension of the IC board 85 in the depth direction 53. That is, the IC board 85 is movable in the groove 91 in the depth direction 53. In other words, the IC board holding portion 90 is configured to hold the IC board 85 such that the IC board 85 is movable relative to the main body 31 in the depth direction (front-rear direction) 53. When the IC board 85 moves in the insertion direction 56 relative to the main body 31 and the front end of the IC board 85 contacts the front wall surface 92, the movement of the IC board 85 in the insertion direction 56 is restricted. Similarly, when the IC board 85 moves in the removal direction 55 relative to the main body 31 and the rear end of the IC board 85 contacts the rear wall surface 93, the movement of the IC board 85 in the removal direction 55 is restricted. That is, the front wall surface 92 and rear wall surface 93, which define the ends of the groove 91 in the depth direction (front-rear direction) 53, are an example of a range limiting portion configured to limit the range of the movement of the IC board 85 relative to the main body 31 in the depth direction (front-rear direction) 53.

The top wall surface 94 and bottom wall surface 95, which define the ends of the groove 91 in the height direction (up-down direction) 52, face each other in the height direction (up-down direction) 52. The distance between the top wall surface 94 and the bottom wall surface 95 in the height direction (up-down direction) 52 (that is, the dimension of the groove 91 in the height direction (up-down direction) 52) is greater than the dimension of the IC board 85 in the height direction (up-down direction) 52. That is, the IC board 85 is movable in the groove 91 in the height direction (up-down direction) 52. In other words, the IC board holding portion 90 is configured to hold the IC board 85 such that the IC board 85 is movable relative to the main body 31 in the height direction (up-down direction) 52. When the IC board 85 moves in the upward direction and the top surface of the IC board 85 contacts the top wall surface 94, the upward movement of the IC board 85 is restricted. Similarly, when the IC board 85 moves in the downward direction and the rear surface of the IC board 85 contacts the bottom wall surface 95, the downward movement of the IC board 85 is restricted. That is, the top wall surface 94 and bottom wall surface 95, which define the ends of the groove 91 in the height direction (up-down direction) 52, are an example of a range limiting portion configured to limit the range of the movement of the IC board 85 relative to the main body 31 in the height direction (up-down direction) 52.

The side wall surface 96, which defines one end of the groove 91 in the width direction (left-right direction) 51, and the side wall surface which defines one end of the groove formed in the inner surface of the side wall 37 (these surfaces will be referred to below as the pair of side wall surfaces) face each other in the width direction (left-right direction) 51. The distance between the pair of side wall surfaces in the width direction (left-right direction) 51 is greater than the dimension of the IC board 85 in the width direction (left-right direction) 51. That is, the IC board 85 is movable in the groove 91 in the width direction (left-right direction) 51. In other words, the IC board holding portion 90 is configured to hold the IC board 85 such that the IC board 85 is movable relative to the main body 31 in the width direction (left-right direction) 51. Assuming that the ink cartridge 30 is viewed in the removal direction 55, when the IC board 85 moves to the right relative to the main body 31 and the right end surface of the IC board 85 contacts the side wall surface 96, the movement of the IC board 85 to the right is restricted. Similarly, when the IC board 85 moves to the left relative to the main body 31 and the left end surface of the IC board 85 contacting a side wall surface corresponding and facing the side wall surface 96, the movement of the IC board 85 to the left is restricted. That is, the pair of side wall surfaces is an example of a range limiting portion configured to limit the range of the movement of the IC board 85 relative to the main body 31 in the width direction (left-right direction) 51.

In this embodiment, a movable distance of the IC board 85 in the width direction (left-right direction) 51 relative to the main body 31 is preferably less than the width of each electrodes 86, 87, and 88 in the width direction 51. For example, there only may be such a clearance between the IC board 85 and the pair of side wall surface that the movement of the IC board 85 in the height direction (up-down direction) 52 and depth direction (front-rear direction) 53 relative to the main body 31 is no impeded.

The above-described space in the IC board holding portion 90 is divided into an upper space 97 and a lower space 98 by the IC board 85. The upper space 97 is formed above the IC board 85. In other words, the top surface (that is, the support surface) of the IC board 85 faces the upper space 97, e.g., is exposed to the upper space 97. The upper space 97 is opened to the outside of the main body 31 in the upward direction and the insertion direction 56. The upper space 97 is accessible from the outside of the main body 31 along the removal direction 55 at least up to a position which overlaps the electrodes 86, 87, and 88 when the upper space 97 is viewed in the height direction (up-down direction) 52. The upper space 97 is an example of a first space.

The lower space 98 is formed below the IC board 85. In other words, the rear surface of the IC board 85 faces the lower space 98, e.g., is exposed to the lower space 98. The lower space 98 is opened to the outside of the main body 31 in the insertion direction 56. The lower space 98 is accessible from the outside of the main body 31 along the removal direction 55 at least up to a position which overlaps the electrodes 86, 87 when the lower space 98 is viewed in the height direction (up-down direction) 52. The lower space 98 is an example of a second space.

[Cartridge Mounting Portion 110]

Figure 4B:
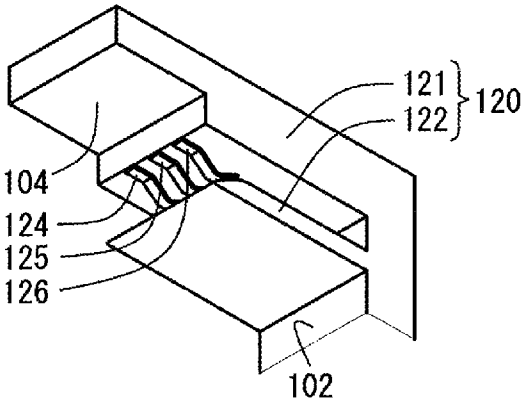
FIG. 4B is a perspective view of a sandwiching portion as viewed from below.
Figure 4C:
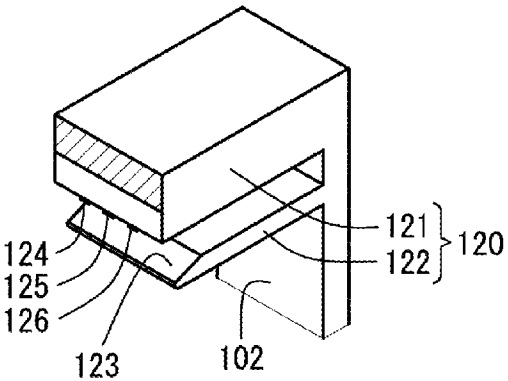
FIG. 4C is a perspective view of the sandwiching portion as viewed from above.
Figure 4A:
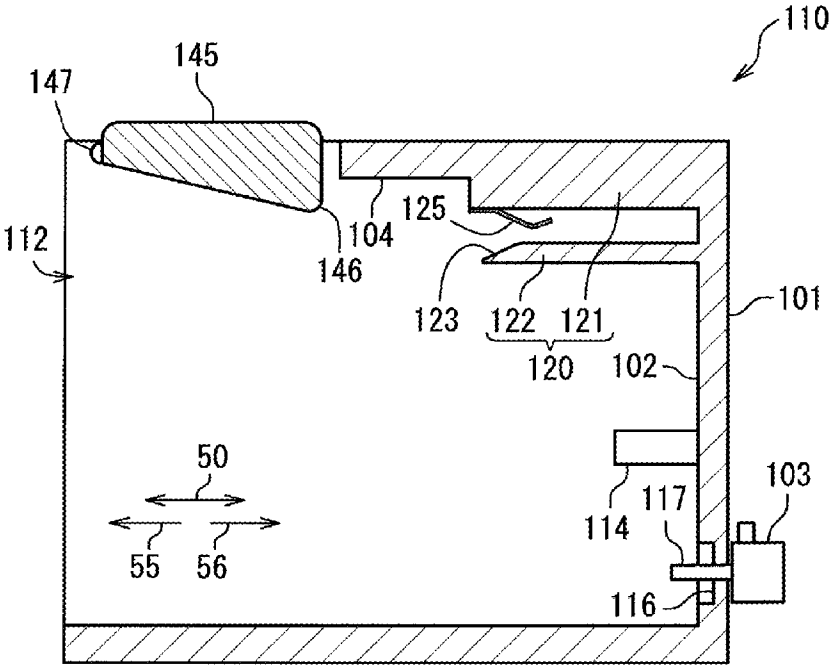
FIG. 4A is a vertical, cross-sectional view of a cartridge mounting portion.

Referring to FIG. 4A, the cartridge mounting portion 110 comprises a case 101 having the opening 112 formed on a user-interface side of the printer 10. The ink cartridge 30 is inserted into and is removed from the case 101 through the opening 112. Although four ink cartridges 30, storing cyan, magenta, yellow and black inks respectively, can be accommodated in the case 101, FIG. 4A illustrates a space of the case 101 in which one ink cartridge 30 can be accommodated.

The case 101 comprises an end surface 102 positioned opposite the opening 112 in the insertion/removal direction 50. The cartridge mounting portion 110 comprises a connection portion 103 provided at a lower portion of the end surface 102. The connection portion 103 is placed at a position corresponding to the ink supply portion 34 of the ink cartridge 30 mounted to the case 101.

The connection portion 103 comprises the ink needle 117 and a holding groove 116. The ink needle 117 is a resin tube, e.g., a cylindrical resin tube. The ink needle 117 is connected to the ink tube 20 at the outside of the case 101. More specifically, the ink needle 117 is connected to a connector at the outside of the case 21 and the ink tube 20 is connected to the connector. The ink tube 20 connected to ink needle 117 at the outside of the case 101 extends in the upward direction along the outer surface of the case 101 and then extends to the recording head 21 of the printer 10. In FIG. 4(A), the ink tube 20 is not illustrated.

Figure 7:
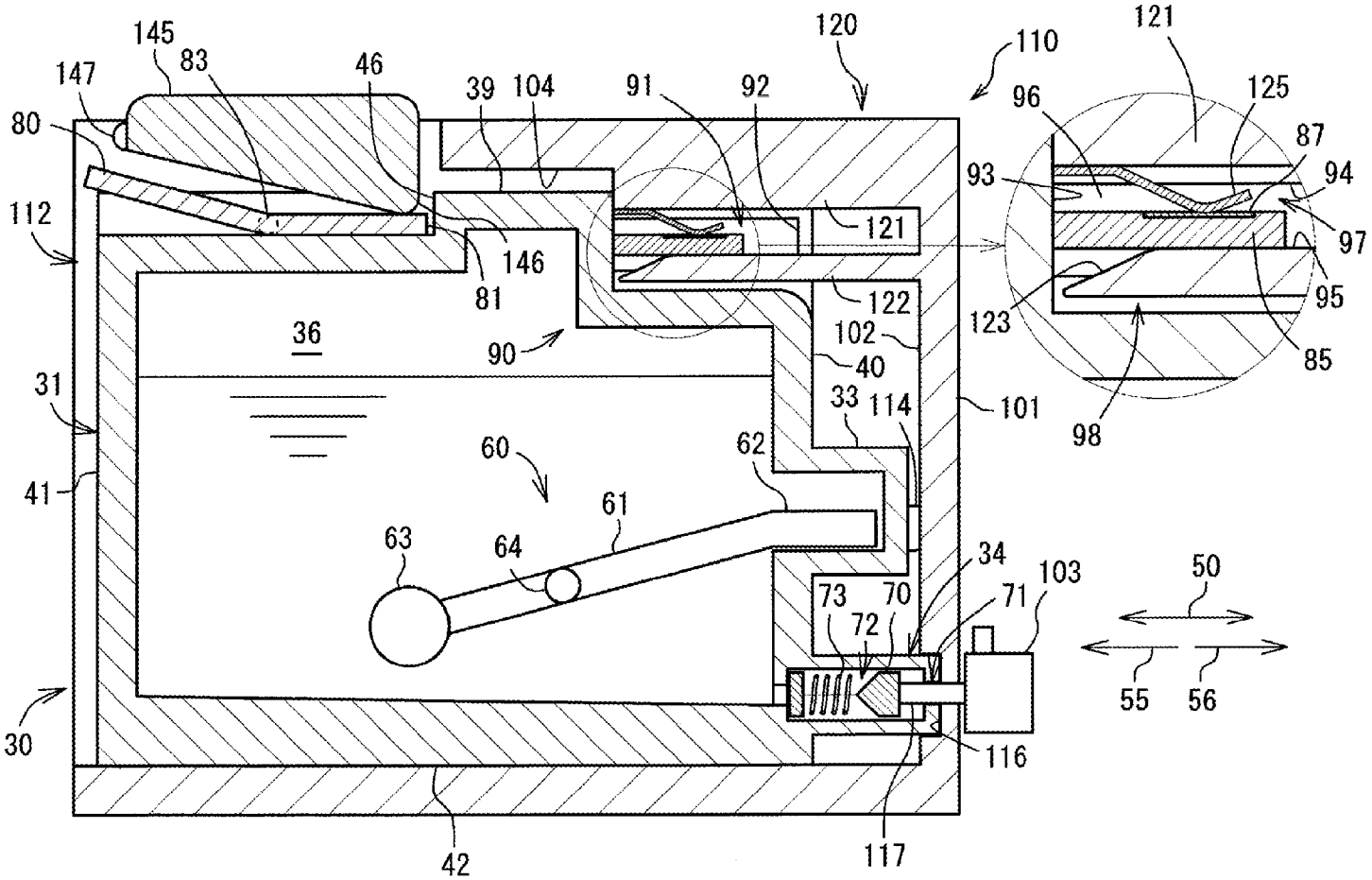
FIG. 7 is a vertical, cross-sectional view of the ink cartridge and the cartridge mounting portion, in which the ink cartridge has been inserted to an excessively inserted position.
Figure 8:
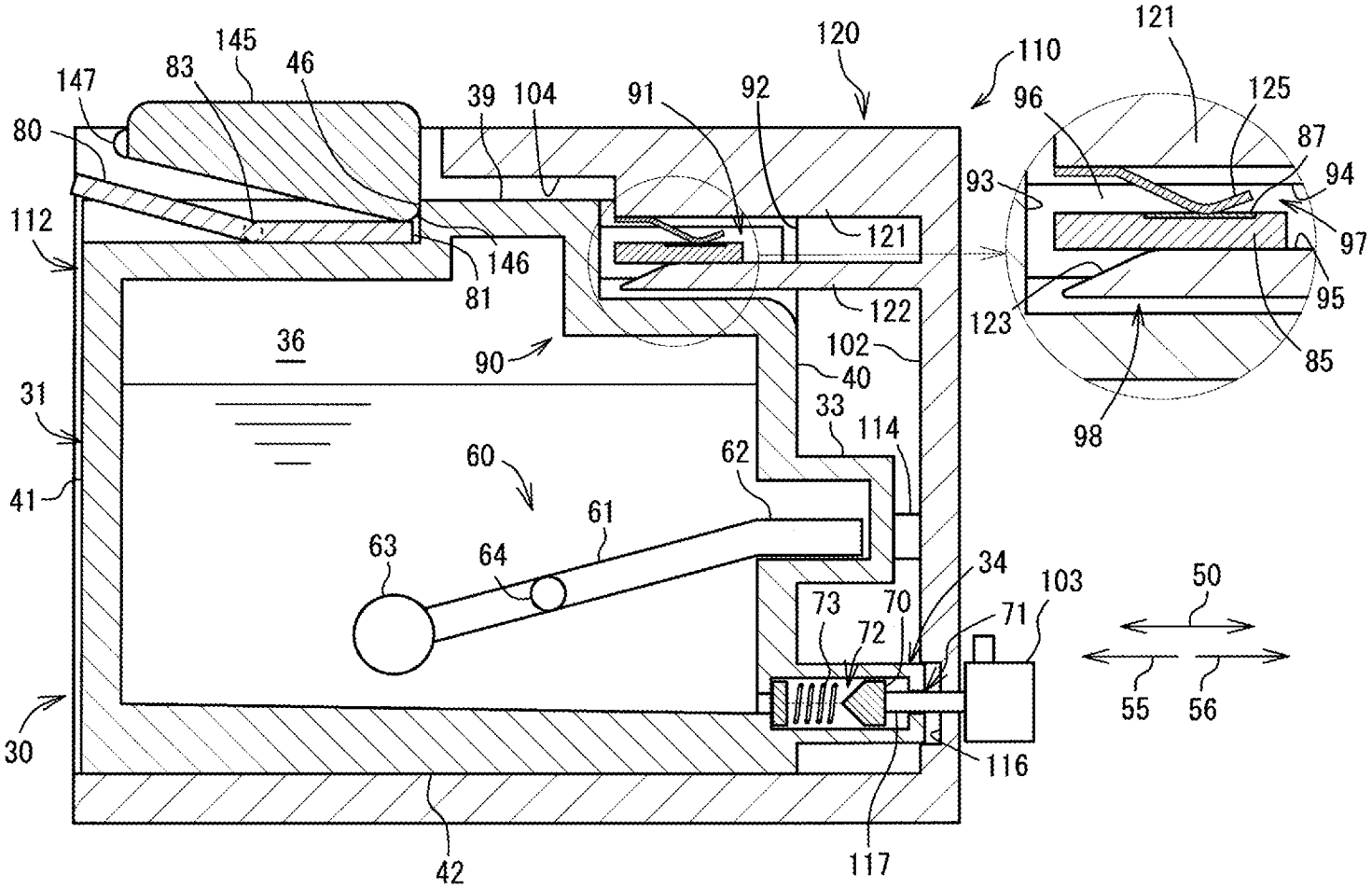
FIG. 8 is a vertical, cross-sectional view of the ink cartridge and the cartridge mounting portion, in which the ink cartridge has been moved to a mounted position.

The holding groove 116 is a groove, e.g., a cylindrical groove formed in the end surface 102. The ink needle 117 is aligned with the central axis of the holding groove 116. Referring to FIGS. 7 and 8, when the ink cartridge 30 is mounted to the cartridge mounting portion 110, the ink supply portion 34 is inserted into the holding groove 116. When this occurs, the cylindrical outer surface of the ink supply portion 34 comes into contact with the cylindrical inner surface of the end surface 102 defining the holding groove 116. When the ink supply portion 34 is inserted into the holding groove 116, the ink needle 117 is inserted into the ink supply opening 71 of the ink supply portion 34. Thus, ink stored in the ink chamber 36 becomes ready to flow to the outside of the ink cartridge 30. The ink that has flowed out of the ink chamber 36 is supplied through the ink needle 117 and ink tube 20 to the recording head 21.

Referring to FIG. 4A, the cartridge mounting portion 110 comprises the optical sensor 114 positioned at the end surface 102 of the case 101 above the connection portion 103. The optical sensor 114 has a light emitting element provided at its one end and a light receiving element provided at its another end. The light emitting element is, for example, an LED or the like, and is configured to emit light in a horizontal direction (width direction (left-right direction 51) perpendicular to the insertion/removal direction 50. The light receiving element is, for example, a phototransistor or the like, and is configured to receive light emitted from the light emitting element. The ink amount detection portion 33 of the ink cartridge 30 is configured to enter a space between the light emitting element and the light receiving element. When the ink amount detection portion 33 intersects an optical path of the optical sensor 114, the optical sensor 114 is configured to detect the light transmission state of the ink amount detection portion 33.

Referring to FIG. 4A, the cartridge mounting portion 110 comprises a sandwiching portion 120 positioned at a top surface 104 of the case 101 adjacent to the end surface 102. When the ink cartridge 30 is mounted to the cartridge mounting portion 110, the sandwiching portion 120 is configured to sandwich the IC board 85 from both sides in the height direction 52. The sandwiching portion 120 comprises a first sandwiching piece 121 and a second sandwiching piece 122, which are spaced away from each other in the height direction (up-down direction) 52.

The first sandwiching piece 121 extends from the end surface 102 along the top surface 104 of the case 101 in the removal direction 55. When the ink cartridge 30 is mounted to the cartridge mounting portion 110, the first sandwiching piece 121 faces the top surface of the IC board 85. More specifically, the first sandwiching piece 121 is inserted into the upper space 97 of the IC board holding portion 90 in the removal direction 55 and reaches a position at which the first sandwiching piece 121 overlaps the electrodes 86, 87, and 88 in the height direction (up-down direction) 52. Referring to FIG. 4B, the first sandwiching piece 121 comprises a bottom surface facing in the downward direction, and supports electrical contacts 124, 125, and 126 provided at the bottom surface of the first sandwiching piece 121. The contacts 124, 125, and 126 are at such positions that they contact the electrodes 86, 87, and 88 provided on the top surface of the IC board 85 when the ink cartridge 30 is mounted to the cartridge mounting portion 110. The contacts 124, 125, and 126 are provided on the bottom surface of the first sandwiching piece 121 and spaced away from each other in the width direction (left-right direction) 51. The contacts 124, 125, and 126 are configured to be resiliently deformed in the height direction (up-down direction) 52 when the IC board 85 is inserted between the first sandwiching piece 121 and the second sandwiching piece 122.

The contact points 124, 125, and 126 are electrically connected via an electric circuit to a calculating unit (not shown). The calculating unit comprises, for example, a CPU, a ROM, a RAM, and the like. The calculating unit may be a controller of the printer 10. When the contact 124 and HOT electrode, as one of the electrodes 86, 87, and 88, are mutually brought into electric conduction, a voltage Vc is applied to the HOT electrode. When the contact 125 and GND electrode, as one of the electrodes 86, 87, and 88, are mutually brought into electric conduction, the GND electrode is grounded. When the contact 124 and HOT electrode are mutually brought into electric conduction and the contact 125 and GND electrode are mutually brought into electric conduction, electric power is supplied to the IC chip on the IC board 85. When the contact 126 and signal electrode, as one of the electrodes 86, 87, and 88 are mutually brought into electric conduction, data stored in the IC chip becomes accessible. An output from the electric circuit is supplied to the calculating unit.

The second sandwiching piece 122 extends from the end surface 102 of the case 101 in the removal direction 55. When the ink cartridge 30 is mounted to the cartridge mounting portion 110, the second sandwiching piece 122 faces the rear surface of the IC board 85. More specifically, the second sandwiching piece 122 is inserted into the lower space 98 of the IC board holding portion 90 in the removal direction 55 and reaches a position at which the second sandwiching piece 122 overlaps the electrodes 86, 87, and 88 in the height direction (up-down direction) 52. Referring to FIG. 4C, the second sandwiching piece 122 comprises a guide surface 123 positioned at its end surface in the removal direction 55, i.e., a surface facing in the removal direction 55. The guide surface 123 is an inclined surface, the height of which is gradually increased in the insertion direction 56. In other words, the lower side of the second sandwiching piece 122 extends more from the end surface of the case 101 than the upper side of the second sandwiching piece 122 extends from the end surface of the case 101. The second sandwiching piece 122 extends up to a position at which the second sandwiching piece 122 overlaps the contacts 124, 125, and 126 when the sandwiching portion 120 is viewed in the height direction (up-down direction) 52.

Referring to FIG. 4A, the cartridge mounting portion 110 comprises the lock member 145 positioned at the case 101. The lock member 145 is configured to retain the ink cartridge 30 mounted to the cartridge mounting portion 110 in the mounted position. The lock member 145 is configured to pivot about a supporting shaft 147 positioned on the opening 112 side of the case 101 for example. Thus, the lock member 145 is configured to pivot clockwise and counterclockwise about the supporting shaft 147. The lock member 145 comprises an locking end 146 positioned opposite to the supporting shaft 147 in the insertion/removal direction 50. The locking end 146 is configured to contact the lock surface 46 of the ink cartridge 30. When contacting the lock surface 46, the locking end 146 retains the ink cartridge 30 at the mounted position in the case 101 against a force causing the ink cartridge 30 to move in the removal direction 55.

A position of the lock member 145 in which the locking end 146 and lock surface 46 can contact each other (see FIG. 8) is referred to as a lock position, and a position of the lock member 145 in which the locking end 146 and lock portion 45 do not contact each other (see FIG. 5) is referred to as an unlock position. The lock member 145 pivots downward by its own weight. When the front end 81 of the pivot member 80 moves upward, the lock member 145 pivots upward about the supporting shaft 147, and thereby moves from the lock position to the unlock position.

[Mounting of the Ink Cartridge 30 to the Cartridge Mounting Portion 110]

Referring to FIGS. 5 to 8, Mounting operation of the ink cartridge 30 to the cartridge mounting portion 110 will be described below with reference to FIGS. 5 to 8.

Figure 5:
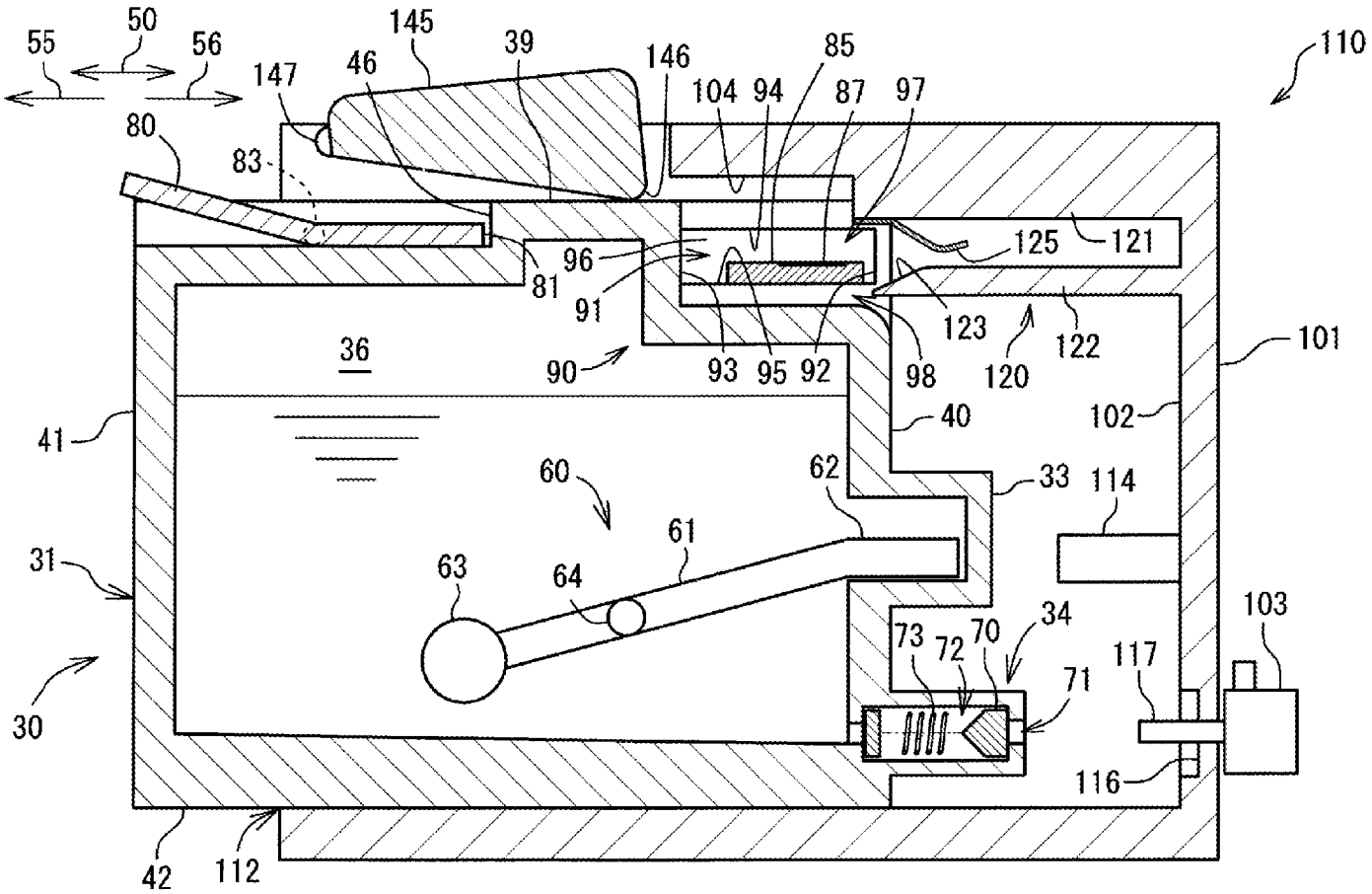
FIG. 5 is a vertical, cross-sectional view of the ink cartridge and the cartridge mounting portion, during insertion of the ink cartridge into the cartridge mounting portion.

First, referring to FIG. 5, when the ink cartridge 30 is inserted into the cartridge mounting portion 110 in the insertion direction 56, the lock member 145 is moved upward by the top wall 39 of the main body 31 and the lock member 145 moves from the lock position to the unlock position. Before the front end of the IC board 85 contacts the guide surface 123, the IC board 85 is in contact with the bottom wall surface 95 of the groove 91 and is held at an arbitrary position in the groove 91 in the depth direction (front-rear direction) 53.

Figure 6:
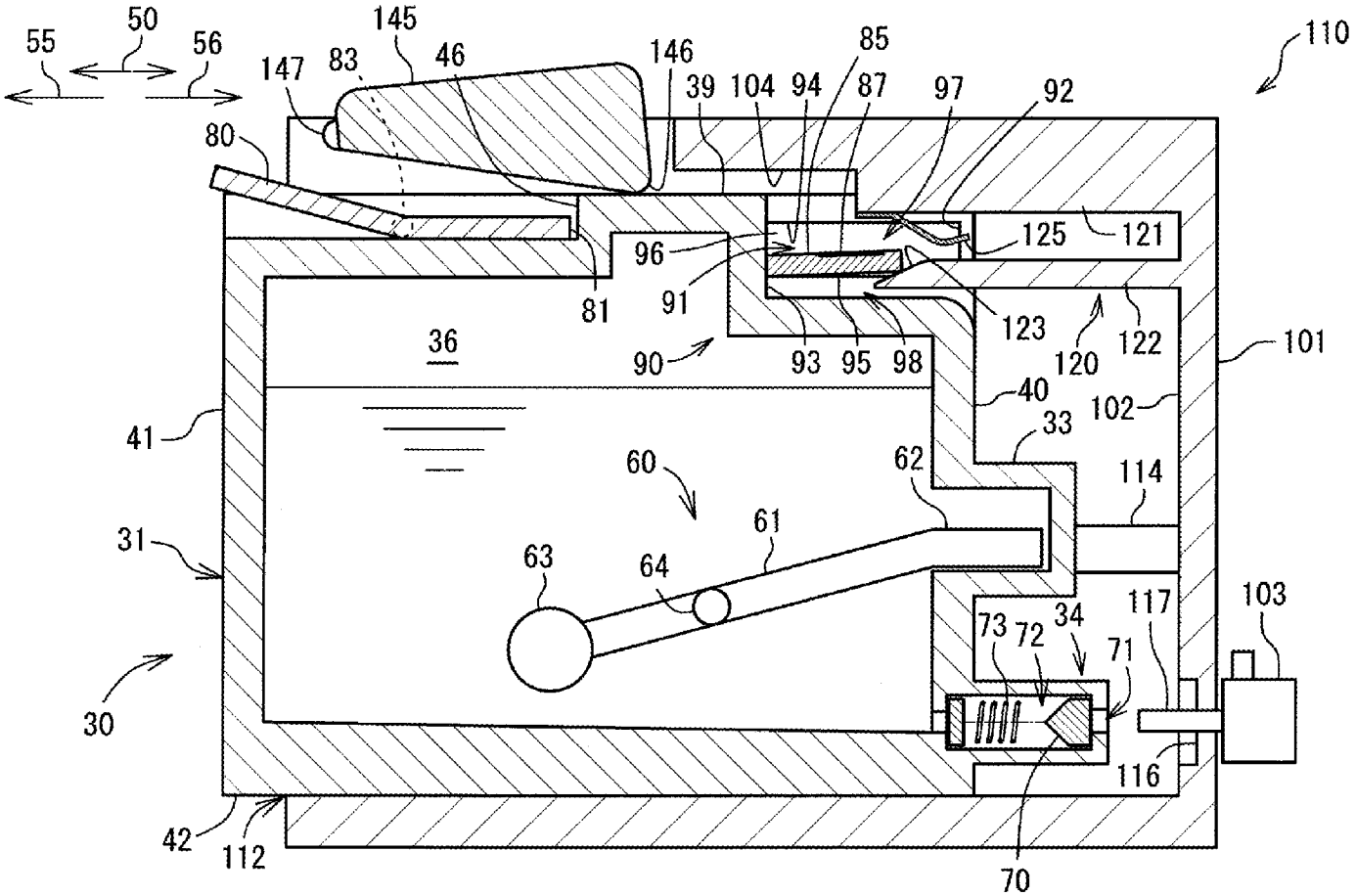
FIG. 6 is a vertical, cross-sectional view of the ink cartridge and cartridge mounting portion, during the insertion of the ink cartridge into the cartridge mounting portion, in which the ink cartridge is further inserted from the position illustrated in FIG. 5.

Subsequently, referring to FIG. 6, when the ink cartridge 30 is further inserted into the cartridge mounting portion 110 in the insertion direction 56, the IC board 85 contacts the guide surface 123 and moves relative to the main body 31 in the depth direction (front-rear direction) 53. That is, the IC board 85 moves relative to the main body 31 in the removal direction 55, and then the rear end of the IC board 85 contacts the rear wall surface 93 of the groove 91. The IC board 85 also moves upward along the guide surface 123.

Subsequently, referring to FIG. 7, when the ink cartridge 30 is inserted up to a position in which the ink supply portion 34 comes into the holding groove 116, the ink needle 117 is inserted into the ink supply opening 71 of the ink supply portion 34. The ink supply valve 70 pressed by the ink needle 117 is separated away from the ink supply opening 71 against the biasing force of the coil spring 73. The IC board 85 is inserted between the first sandwiching piece 121 and the second sandwiching piece 122 while pressing contacts 124, 125, and 126 in the upward direction, such that the IC board 85 is sandwiched by the first sandwiching piece 121 and second sandwiching piece 122 in the height direction (up-down direction) 52. The electrodes 86, 87 and 88 and the contacts 124, 125 and 126 contact each other, electrically connecting the IC chip on the IC board 85 to the calculating unit of the printer 10. The second sandwiching piece 122 contacts the rear surface of the IC board 85.

Moreover, referring to FIG. 7, the lock member 145, which has reached the lock portion 45 of the main body 31, pivots downward and moves to the lock position because the lock member 145 is no longer supported by the top wall 39 of the main body 31. Then, the locking end 146 and the lock surface 46 face each other in the depth direction (front-rear direction) 53. The ink cartridge 30 illustrated in FIG. 7 is in an excessively inserted state (overshooting), in which the front end of the ink supply portion 34 contacting the end surface of the holding groove 116, and the locking end 146 and the lock surface 46 are separated away from each other in the depth direction (front-rear direction) 53.

Accordingly, when the force pressing the ink cartridge 30 in the insertion direction 56 is removed in the state illustrated in FIG. 7, i.e., when a user stops inserting the ink cartridge 30 and remove his/her finger off the ink cartridge 30, the ink cartridge 30 retracts, in the removal direction 55, to a position in which the locking end 146 and lock surface 46 come into contact as illustrated in FIG. 8. This is because the compressed coil spring 73 expands in the insertion/removal direction 50 and applies a force to the main body 31 in the removal direction 55. Thus, the lock member 145 retains the ink cartridge 30 in the cartridge mounting portion 110 against the force causing the ink cartridge 30 to move in the removal direction 55. The front end 81 of the pivot member 80 in FIG. 8 is positioned below the lock member 145. The rear end 82 of the pivot member 80 is separated from the bottom surface of the groove in the lock portion 45 and is positioned above the top wall 39 of the main body 31. In this embodiment, the position of the ink cartridge 30 in FIG. 7 is called the excessively inserted position, and the position of the ink cartridge 30 in FIG. 8 is called the mounted position.

The front end of the ink supply portion 34 in the mounted position is slightly spaced away from the end surface of the holding groove 116. However, the ink needle 117 is still in the ink supply portion 34 and is separating the ink supply valve 70 away from the ink supply opening 71. Therefore, it is possible for ink to flow out of the ink chamber 36 through an opening (not illustrated) formed in the front end of the ink needle 117. Similarly, in the mounted position, the ink amount detection portion 33 is positioned such that its light transmission state is detected by the optical sensor 114.

In the state illustrated in FIG. 7, the IC board 85 has been already sandwiched by the first sandwiching piece 121 and second sandwiching piece 122, and therefore even if the ink cartridge 30 retracts from the excessively inserted position to the mounted position, the position of the IC board 85 remains unchanged. The rear end of the IC board 85 is thus separated away from the rear wall surface 93 of the groove 91. The electrodes 86, 87 and 88 and the contacts 124, 125 and 126 remain in contact. This completes mounting of the ink cartridge 30 to the cartridge mounting portion 110.

When the ink in the ink chamber 36 in the ink cartridge 30 is consumed, the used ink cartridge 30 is removed from the cartridge mounting portion 110 and a new ink cartridge 30 is mounted.

When the ink cartridge 30 is removed from the cartridge mounting portion 110, the rear end 82 of the pivot member 80 is pressed downward by a user. The front end 81 of the pivot member 80 is thereby moved upward and is separated away from the bottom surface of the lock portion 45. The lock member 145 pivots upward from the lock position to the unlock position due to this movement of the front end 81, and the ink cartridge 30 is released from the state in which the ink cartridge 30 is retained by the lock member 145.

When the lock member 145 pivots to the unlock position, the ink cartridge 30 is moved in the removal direction 55 due to the force causing ink cartridge 30 to move in the removal direction 55. When the ink cartridge 30 is moved in the removal direction 55, the ink needle 117 is pulled out of the ink supply portion 34. Therefore, the ink supply valve 70 is pressed by the coil spring 73 and blocks the ink supply opening 71.

When the ink cartridge 30 is further moved in the removal direction 55, the IC board 85 moves relative to the main body 31 in the groove 91 in the insertion direction 56. The IC board 85 then contacts the front wall surface 92, and moves together with the main body 31 in the removal direction 55 and is removed from the sandwiching portion 120. Thus, the electrodes 86, 87 and 88 and the contacts 124, 125 and 126 are separated away from each other, releasing the electric connection between the IC chip on the IC board 85 and the calculating unit of the printer 10.

In this embodiment, by the ink needle 117 being inserted into the ink supply opening 71, the position of the ink cartridge 30 relative to the cartridge mounting position 110 is fixed. On the other hand, the IC board 85 is held so as to be movable relative to the main body 31 in the width direction (left-right direction) 51, height direction (up-down direction) 52, and depth direction (front-rear direction) 53. Accordingly, the IC board 85 is moved to an appropriate position while being guided by the guide surface 123 and is sandwiched by the sandwiching portion 120 during the mounting of the ink cartridge 30 to the cartridge mounting portion 110. As a result, stable electric contacts can be realized between the electrodes 86, 87 and 88 and the contacts 124, 125 and 126 without having to apply an unreasonable force to the IC board 85.

The ink cartridge 30 in this embodiment has a shape with a relatively long height dimension. Because the IC board 85 can move to an appropriate position in the height direction (up-down direction) 52 as described above, even if the position of the ink cartridge 30 relative to the cartridge mounting portion 110 is fixed at the lower portion of the main body 31 at which the ink supply portion 34 is provided, stable electric contacts can be realized between the electrodes 86, 87 and 88 and the contacts 124, 125 and 126 at the upper portion of the main body 31. Because the IC board 85 is positioned above the ink supply portion 34, even if ink leaks from the ink supply portion 34, the IC board 85 is not contaminated by the ink In this embodiment, the second sandwiching piece 122 extends to a position at which it overlaps the contacts 124, 125, and 126 when viewed in the height direction (up-down direction) 52, and the first sandwiching piece 121 and second sandwiching piece 122 can access a position at which they overlap the electrodes 86, 87, and 88 in the upper space 97 and lower space 98 when viewed in the height direction (up-down direction) 52. As a result, the sandwiching portion 120 can stably sandwich the IC board 85.

In this embodiment, because the ink cartridge 30 is pressed to the excessively inserted position with the IC board 85 contacting the rear wall surface 93 of the groove 91, the position of IC board 85 is fixed in the depth direction (front-rear direction) 53, and therefore the electrodes 86, 87 and 88 and the contacts 124, 125 and 126 can reliably contact each other. As a result, the dimensions of the electrodes 86, 87 and 88 in the depth direction (front-rear direction) 53 can be shortened while stable electric contacts are maintained between the electrodes 86, 87 and 88 and the contacts 124, 125 and 126.

Moreover, because the ink cartridge 30 retracts from the excessively inserted position to the mounted position with the IC board 85 being sandwiched by the sandwiching portion 120, there is no friction between the electrodes 86, 87 and 88 and the contacts 124, 125 and 126 during retraction of the ink cartridge 30. As a result, it is possible to suppress the wear of the contacts 124, 125 and 126.

First Modified Embodiment

Figure 9A:
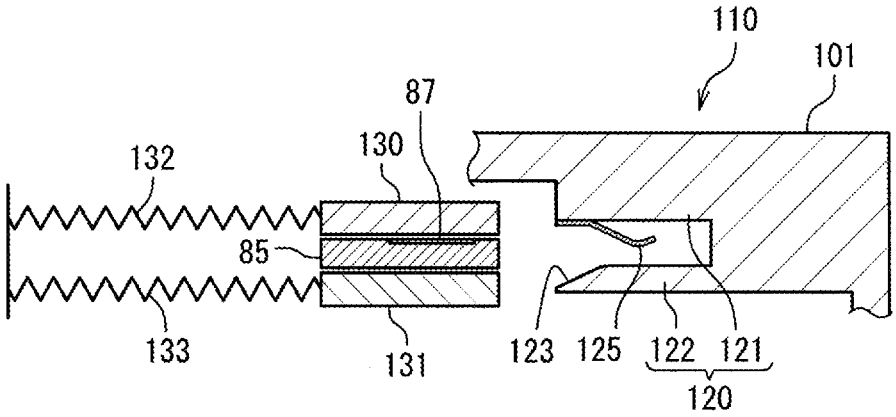
FIG. 9A is a partial, vertical, cross-sectional view of the ink cartridge and the cartridge mounting portion according to a first modified embodiment, illustrating an IC board and the sandwiching portion, in which the ink cartridge is not mounted to the cartridge mounting portion.
Figure 9B:
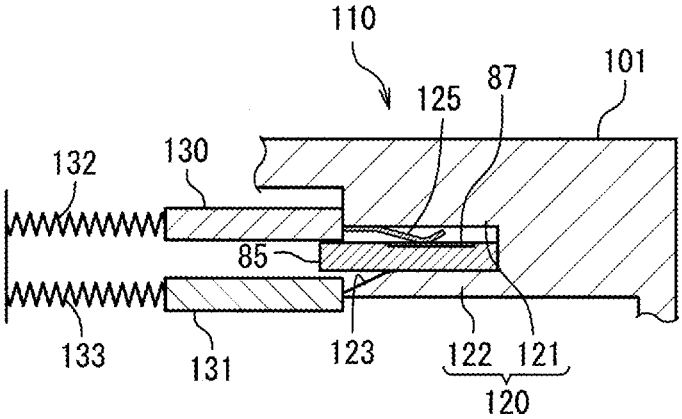
FIG. 9B is a partial, vertical, cross-sectional view of the ink cartridge and the cartridge mounting portion according to the first modified embodiment, illustrating the IC board and the sandwiching portion, in which the ink cartridge has been mounted to the cartridge mounting portion.

Referring to FIGS. 9A and 9B, a first modified embodiment will be described. Detailed descriptions common to the above-described embodiment will be omitted and differences from the above-described embodiment will be mainly described. The first modified embodiment differs from the above-described embodiment in that the ink cartridge 30 comprises a board cover member 130 positioned in the upper space 97 and a board cover member 131 positioned in the lower space 98.

Referring to FIGS. 9A and 9B, the board cover member 130 is resiliently supported by a coil spring 132. One end of the coil spring 132 is linked to a surface of the board cover member 130, which surface faces in the removal direction 55, and the other end of the coil spring 132 is linked to an outer surface of the main body 31, which outer surface faces in the insertion direction 56. The board cover member 130 is an example of a first movable member. When the ink cartridge 30 is not mounted to the cartridge mounting portion 110, that is, when the coil spring 132 is maintained at its natural length, the board cover member 130 covers the top surface of the IC board 85 at the upper space 97 as illustrated in FIG. 9A. The position of the board cover member 130 illustrated in FIG. 9A is a first position.

The board cover member 130 contacts the front end of the first sandwiching piece 121 during the insertion of the ink cartridge 30 into the cartridge mounting portion 110. The board cover member 130 pressed by the first sandwiching piece 121 in the removal direction 55 moves to a position retracted from the upper space 97 against the biasing force of the coil spring 132 as illustrated in FIG. 9B, exposing the top surface of the IC board 85 to the upper space 97. The position of the board cover member 130 illustrated in FIG. 9B is a second position. That is, when the ink cartridge 30 is mounted to the cartridge mounting portion 110, the first sandwiching piece 121 is inserted into the upper space 97, replacing the board cover member 130, and contacts the top surface of the IC board 85.

Referring to FIGS. 9A and 9B, the board cover member 131 is resiliently supported by a coil spring 133. One end of the coil spring 133 is linked to a surface of the board cover member 131, which surface faces in the removal direction 55, and the other end of the coil spring 133 is linked to an outer surface of the main body 31, which outer surface faces in the insertion direction 56. The board cover member 131 is an example of a second movable member. When the ink cartridge 30 is not mounted to the cartridge mounting portion 110, that is, when the coil spring 133 is maintained at its natural length, the board cover member 131 covers the rear surface of the IC board 85 at the lower space 98 as illustrated in FIG. 9A. The position of the board cover member 131 illustrated in FIG. 9A is a third position.

The board cover member 131 contacts the front end of the second sandwiching piece 122 during the insertion of the ink cartridge 30 into the cartridge mounting portion 110. The board cover member 131 pressed by the second sandwiching piece 122 in the removal direction 55 moves to a position retracted from the lower space 98 against the biasing force of the coil spring 133 as illustrated in FIG. 9B, exposing the rear surface of the IC board 85 to the lower space 98. The position of the board cover member 131 illustrated in FIG. 9B is a fourth position. That is, when the ink cartridge 30 is mounted to the cartridge mounting portion 110, the second sandwiching piece 122 is inserted into the lower space 98, replacing the board cover member 131, and contacts the rear surface of the IC board 85.

The top surface and rear surface of the IC board 85 do not need to be always exposed to the upper space 97 and lower space 98 as in this first modified embodiment. That is, when the ink cartridge 30 is not mounted to the cartridge mounting portion 110, the IC board 85 may be covered by the board cover member 130 and board cover member 131. In other words, the upper space 97 and lower space 98 only need to be formed so as to receive the first sandwiching piece 121 and second sandwiching piece 122 during the mounting of the ink cartridge 30 to the cartridge mounting portion 110.

In the first modified embodiment, the IC board 85 can be protected when, for example, the ink cartridge 30 is shipped from a factory. More specifically, the IC chip and electrodes 86, 87, and 88 mounted on the IC board 85 can be protected by the board cover member 130, which covers the top surface of the IC board 85. By the board cover member 131, which supports the IC board 85 from below, it is also possible to prevent the IC board 85 from being deformed or damaged by an external force exerted on the IC board 85.

In the first modified embodiment, both the board cover member 130 and board cover member 131 are provided. However, in another embodiment, only any one of the board cover member 130 and board cover member 131 may be provided.

In the first modified embodiment, the board cover member 130 is moved from the first position to the second position by the first sandwiching piece 121 and the board cover member 131 is moved from the third position to the fourth position by the second sandwiching piece 122. However, in another embodiment, a user may remove the board cover member 130 and board cover member 131 before the ink cartridge 30 is mounted to the cartridge mounting portion 110.

Second Modified Embodiment

Next, referring to FIG. 10 a second modified embodiment will be described. Detailed descriptions common to the above-described embodiment will be omitted and differences from the above-described embodiment will be mainly described. The second modified embodiment differs from the above-described embodiment in that the ink supply device 100 comprises a positioning portion 106 configured to determine the positioning of the IC board 85 relative to the cartridge mounting portion 110 in the width direction (left-right direction) 51. That is, in the second modified embodiment, a movable distance of the IC board 85 in the width direction (left-right direction) 51 relative to the main body 31 does not necessarily need to be less than the width of each of the electrodes 86, 87, and 88 in the width direction (left-right direction) 51.

Figure 10A:
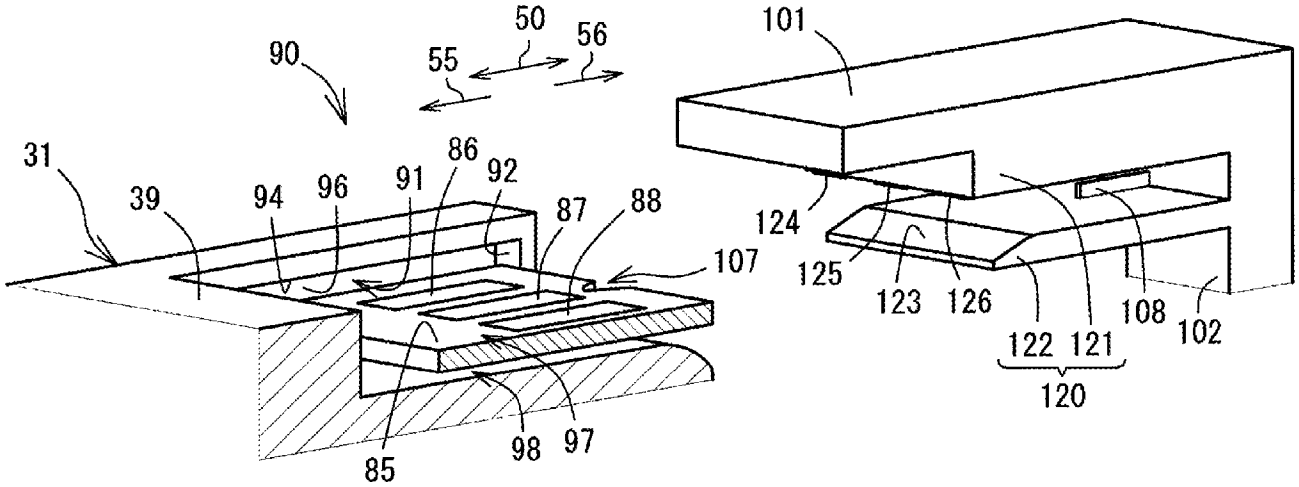
FIG. 10A is a partial, perspective view of the ink cartridge and the cartridge mounting portion according to a second modified embodiment, illustrating the IC board and the sandwiching portion, in which the ink cartridge is not mounted to the cartridge mounting portion.

Referring to FIG. 10A, the positioning portion 106 comprises a notch portion 107 formed at the central part of the IC board 85 in the width direction (left-right direction) 51 and a protrusion 108 extending at the central part of the top surface of the second sandwiching piece 122 in the width direction (left-right direction) 51. The notch portion 107 comprises a pair of wall surfaces spaced away from and facing each other in the width direction (left-right direction) 51, and a space formed between the pair of wall surfaces of the notch portion 107 has a distal end and a based end opposite the distal end in the depth direction (front-rear direction) 53. The distal end of the space is opened at the front end of the IC board 85, facing the cartridge mounting portion 110, in the insertion direction 56. A distance of the pair of wall surfaces of the notch portion 107 in the width direction (left-right direction) 51 is more narrowed at a position closer to the base end than at a position closer to the distal end. The pair of wall surfaces cross at the base end. The notch portion 107 is an example of a guide portion and the protrusion 108 is an example of a guide objective portion.

Figure 10B:
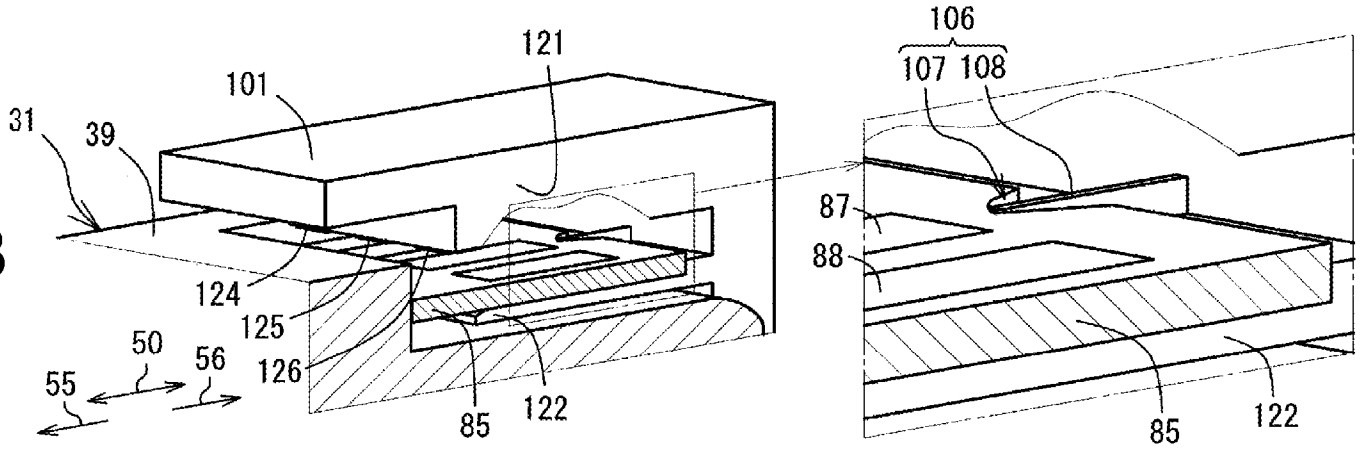
FIG. 10B is a partial, perspective view of the ink cartridge and the cartridge mounting portion according to the second modified embodiment, illustrating the IC board and the sandwiching portion, in which the ink cartridge has been mounted to the cartridge mounting portion.

The protrusion 108 moves relative to the notch portion 107 between the pair of wall surfaces of the notch portion 107 in the removal direction 55 and reaches the base end of the space of the notch portion 107 as illustrated in FIG. 10B during the insertion of the ink cartridge 30 to the cartridge mounting portion 110. When the ink cartridge 30 is inserted into the cartridge mounting portion 110 with the electrodes 86, 87, and 88 of the IC board 85 shifted from the contacts 124, 125, and 126 in the width direction (left-right direction) 51, the protrusion 108 contacts one of the pair of wall surfaces of the notch portion 107, such that the IC board 85 moves between the first sandwiching piece 121 and the second sandwiching piece 122 in the insertion direction 56 while moving in the width direction (left-right direction) 51. As a result, the position of the IC board 85 relative to the cartridge mounting portion 110 in the width direction (left-right direction) 51 is fixed portion 110, and therefore the widths of the electrodes 86, 87 and 88 in the width direction (left-right direction) 51 can be shortened while stable electric contacts are maintained between the electrodes 86, 87 and 88 and the contacts 124, 125 and 126.

In another embodiment, the notch portion 107 may be formed at the cartridge mounting portion 110 (sandwiching portion 120) and the protrusion 108 may be provide at the IC board 85. The positions of the notch portion 107 and protrusion 108 are not limited to the central parts of the IC board 85 and second sandwiching piece 122 in the width direction 51. The notch portion 107 and protrusion 108 may be provided at any positions as long as they do not interfere with the electrodes 86, 87 and 88 or the contacts 124, 125 and 126.

Third Modified Embodiment

Referring to FIGS. 11A to 11D, a third modified embodiment will be described with reference to FIG. 11. Detailed descriptions common to the above-described embodiment will be omitted and differences from the above-described embodiment will be mainly described. The third modified embodiment differs from the above-described embodiment in that the rear wall surface 93, which defines the groove 91, is resiliently movable in the depth direction (front-rear direction) 53. The rear wall surface 93 in the above-described embodiment is the same plane as the outer surface of the main body 31, which outer surface faces in the insertion direction 56 and closes the space formed in the IC board holding portion 90 in the removal direction 55. By contrast, the rear wall surface 93 in the third modified embodiment is provided on a wall member 135, which is movable in the groove 91 in the insertion/removal direction 50.

More specifically, referring to FIGS. 11A to 11D, the IC board holding portion 90 comprises the wall member 135 and a coil spring 136 supporting and biasing the wall member 135 in the insertion direction 56. The coil spring 136 contacts a surface of the wall member 135, which surface faces in the removal direction 55. A surface of the wall member 135 facing in the insertion direction 56 comprises the rear wall surface 93 of the groove 91. A wall surface 127 of the sandwiching portion 120 facing in the removal direction 55 and positioned between the first sandwiching piece 121 and the second sandwiching piece 122 at the deepest part of the sandwiching portion 120 in the insertion direction 56 is an example of a movement limiting portion. The wall surface 127 as the movement limiting portion is configured to limit the movement of the IC board 85 relative to the cartridge mounting portion 110 in the insertion direction 56. The coil spring 136 is an example of an resilient member.

The wall member 135 is a substantially T-shaped (or cross-shaped) member having a protrusion (not illustrated) extending toward both ends in the width direction (left-right direction) 51 when viewed in the removal direction 55. The both ends of the protrusion of the wall member 135 is inserted into the pair of grooves formed in the IC board holding portion 90, and the wall member 135 is movable in the insertion/removal direction 50 by being guided in the pair of grooves. That is, the groove 91 in the third modified embodiment is divided by the wall member 135 into an insertion-direction-56-side area and a removal-direction-55-side area relative to the wall member 135. In the third modified embodiment, the IC board 85 is held in the insertion-direction-56-side area of the groove 91 relative to the wall member 135.

Figure 11A:
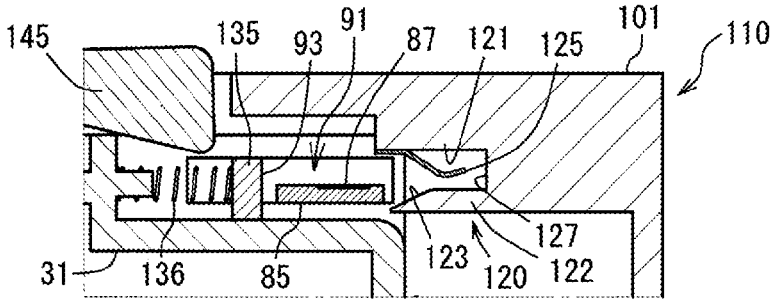
FIG. 11A is a partial, cross-sectional view of the ink cartridge and the cartridge mounting portion according to a third modified embodiment, illustrating the IC board and the sandwiching portion, in a state corresponding to the state illustrated in FIG. 5.
Figure 11B:
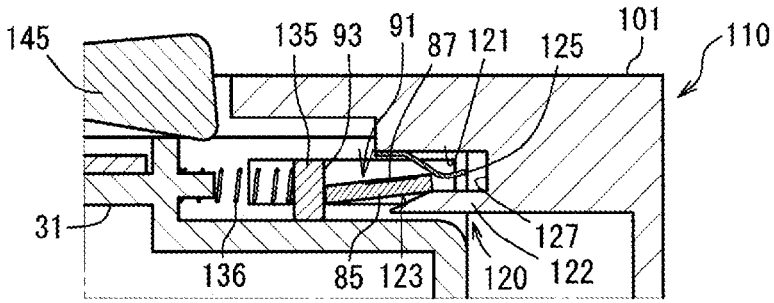
FIG. 11B is a partial, cross-sectional view of the ink cartridge and the cartridge mounting portion according to the third modified embodiment, illustrating the IC board and the sandwiching portion, in a state corresponding to the state illustrated in FIG. 6.

Referring to FIG. 11A, the wall member 135 is in the most frontward position in the groove 91 in the insertion direction 56 when the ink cartridge 30 is not mounted to the cartridge mounting portion 110. Subsequently, during the insertion of the ink cartridge 30 into the cartridge mounting portion 110, even if the IC board 85 pressed by the guide surface 123 contacts the rear wall surface 93, the wall member 135 does not move in the groove 91 in the removal direction 55 as illustrated in FIG. 11B. That is, the coil spring 136 biases the wall member 135 in the insertion direction 56 with a force stronger than a force with which the guide surface 123 presses the IC board 85 in the removal direction 55.

When the ink cartridge 30 is further inserted into the cartridge mounting portion 110 in the insertion direction 56, the front end of the IC board 85 contacts the wall surface 127 as the movement limiting portion. Thus, the movement of the IC board 85 in the insertion direction 56 is restricted. That is, the position of the IC board 85 relative to the cartridge mounting portion 110 in the depth direction (front-rear direction) 53, i.e., the insertion/removal direction 50 is fixed, and the electrodes 86, 87 and 88 and the contacts 124, 125 and 126 contact each other. The IC board 85 is sandwiched by the wall surface 127 as the movement limiting portion and the wall member 135 from both sides in the depth direction (front-rear direction) 53, i.e., the insertion/removal direction 50.

Figure 11C:
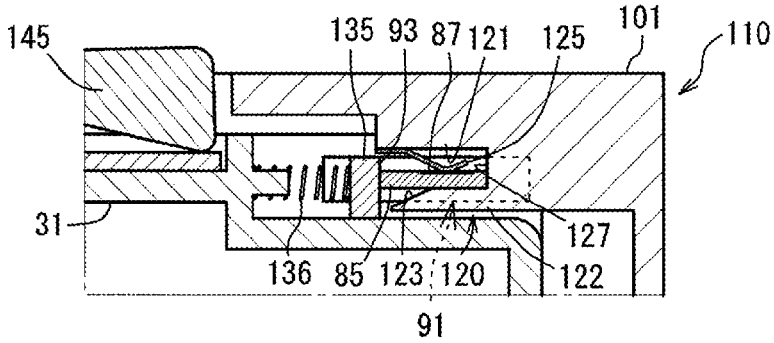
FIG. 11C is a partial, cross-sectional view of the ink cartridge and the cartridge mounting portion according to the third modified embodiment, illustrating the IC board and the sandwiching portion, in a state corresponding to the state illustrated in FIG. 7.
Figure 11D:
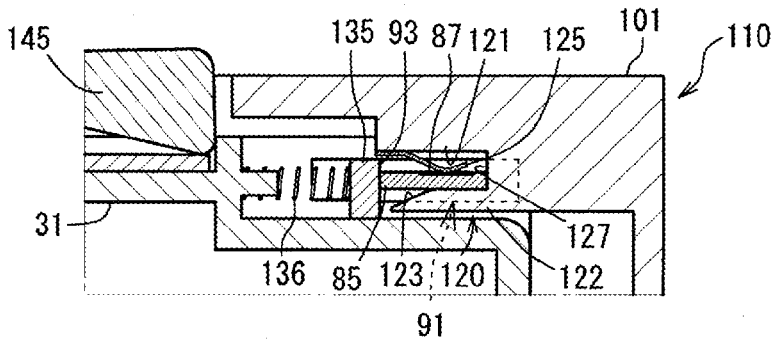
FIG. 11D is a partial, cross-sectional view of the ink cartridge and the cartridge mounting portion according to the third modified embodiment, illustrating the IC board and the sandwiching portion, in a state corresponding to the state illustrated in FIG. 8.

Subsequently, when the ink cartridge 30 is inserted to the excessively inserted position, the wall member 135 pressed by the rear end of the IC board 85 moves in the removal direction 55 against the biasing force of the coil spring 136 as illustrated in FIG. 11C. That is, the insertion-direction-56-side area of the groove 91 relative to the wall member 135 is expanded in the removal direction 55. When the ink cartridge 30 moves from the excessively inserted position to the mounted position, the wall member 135 moves in the insertion direction 56 as illustrated in FIG. 11D. That is, the insertion-direction-56-side area of the groove 91 which has been expanded in the removal direction 55 is contracted in the insertion direction 56.

As described above, the wall member 135 is configured to move in the groove 91 in the removal direction 55 by the wall surface 127 as the movement limiting portion 127 limiting the movement of the IC board 85 in the insertion direction 56. In other words, the wall member 135 is configured to resiliently expand the range of the movement of the IC board 85 relative to the main body 31 in the removal direction 55. The wall member 135 is movable in the depth direction 53 to prevent an excessive force from acting on the IC board 85 sandwiched by the wall surface 127 as the movement limiting portion and the wall member 135.

Forth Modified Embodiment

Figure 12:
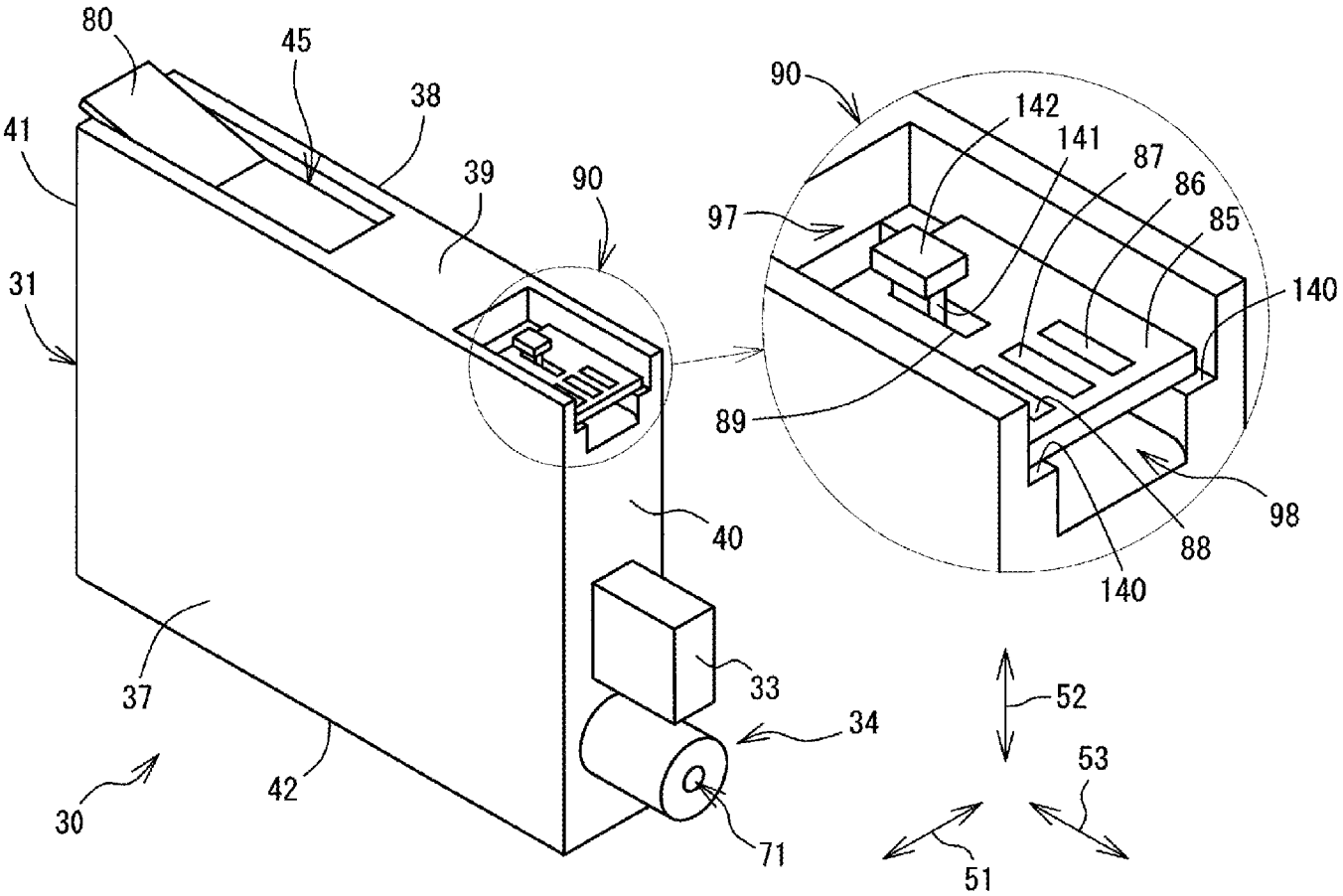
FIG. 12 is a perspective view of the ink cartridge according to a fourth modified embodiment.

Referring to FIG. 12, a fourth modified embodiment be described. Detailed descriptions common to the above-described embodiment will be omitted and differences from the above-described embodiment will be mainly described. The fourth modified embodiment differs from the above-described embodiment in that the IC board holding portion 90 comprises a pair of mounting portions 140, a columnar member 141, and a removal preventing portion 142.

Referring to FIG. 12, the pair of mounting portions 140 extend along the inner surfaces of the side walls 37 and 38 in the depth direction (front-rear direction) 53 in the IC board holding portion 90. The pair of mounting portions 140 faces in the upward direction of the height direction (up-down direction) 52. The columnar member 141 extends in the upward direction of the height direction (up-down direction) 52 from the bottom surface that closes the space of the IC board holding portion 90 in the downward direction of the height direction (up-down direction) 52. The columnar member 141 has a rectangular parallelepiped shape. The IC board 85 has an opening 89 formed therethrough in the height direction (up-down direction) 52 at a position closer to the rear end of the IC board 85 than the electrodes 86, 87, and 88 are. The opening 89 has a rectangular parallelepiped shape.

The IC board 85 is placed on the pair of mounting portions 140. The columnar member 141 is inserted into the opening 89. The columnar member 141 has a dimension which is greater than the dimension of the IC board 85 in the height direction (up-down direction) 52. The removal preventing portion 142, which prevents the columnar member 141 from being detached from the opening 89, is fixed to the upper end of the columnar member 141. That is, a dimension of the removal preventing portion 142 is greater than a dimension of the opening 89 in at least one of the width direction (left-right direction) 51 and depth direction (front-rear direction) 53.

The IC board 85 is movable along the columnar member 141 in the height direction (up-down direction) 52, from a position in which the IC board 85 contacts the pair of mounting portions 140 to a position in which the IC board 85 contacts the removal preventing portion 142. That is, the pair of mounting portions 140 is configured to limit the range of downward movement of the IC board 85 relative to the main body 31. The removal preventing portion 142 is configured to limit the range of upward movement of the IC board 85 relative to the main body 31. The dimensions of the opening 89 in the width direction (left-right direction) 51 and the depth direction (front-rear direction) 53 are greater than the dimensions of the columnar member 141 in the width direction (left-right direction) 51 and the depth direction (front-rear direction) 53, respectively. That is, the IC board 85 is movable relative to the main body 31 in the width direction (left-right direction) 51 and depth direction (front-rear direction) 53. The columnar member 141 comprises a pair of surfaces extending in the height direction (up-down direction) 52 and the depth direction (front-rear direction) 53, which pair of surfaces is configured to limit the range of the movement of the IC board 85 relative to the main body 31 in the width direction (left-right direction) 51. The columnar member 141 comprises a pair of surfaces extending in the width direction (left-right direction) 51 and the height direction (up down direction) 52, which pair of surfaces is configured to limit the range of the movement of the IC board 85 relative to the main body 31 in the depth direction (front-rear direction) 53.

Other Modified Embodiments

In the above-described embodiment and modified embodiments, the electrodes 86, 87, and 88 are provided on the top surface of the IC board 85 and the contacts 124, 125, and 126 are provided on the bottom surface of the first sandwiching piece 121. Nevertheless, the present invention is not limited to that structure. For example, in another embodiment the electrodes 86, 87, and 88 may be provided on the rear surface of the IC board 85, and the contacts 124, 125, and 126 may be provided on the top surface of the second sandwiching piece 122. The guide surface 123 may be provided on one of the first sandwiching piece 121 and second sandwiching piece 122.

In the above-described embodiment and modified embodiments, the depth direction (front-rear direction) 53 is the first direction, the height direction (up-down direction) 52 is the second direction, and the width direction (left-right direction) 51 is the third direction. Nevertheless, the present invention is not limited to that structure. For example, the width direction (left-right direction) 51 may be the second direction and the height direction (up-down direction) 52 may be the third direction. That is, the ink cartridge 30 may hold the IC board 85, such that the surface of the IC board 85 on which the electrodes 86, 87, and 88 are provided faces to the left or right.

Moreover, in the above-described embodiment and modified embodiments, ink is used as printing fluid. Nevertheless, the present invention is not limited to using ink. That is, other liquids or toner and other fine particles may be used as printing fluid.

The above-described embodiment and modified embodiments can be arbitrarily combined without departing from the scope of the invention.

While the invention has been described in connection with various example structures and illustrative embodiments, it will be understood by those skilled in the art that other variations and modifications of the structures and embodiments described above may be made without departing from the scope of the invention. Other structures and embodiments will be understood by those skilled in the art from a consideration of the specification or practice of the invention disclosed herein. It is intended that the specification and the described examples are merely illustrative and that the scope of the invention is defined by the following claims.

The invention claimed is:

1. A printing fluid supply device comprising:

a cartridge mounting portion; and a printing fluid cartridge configured to be inserted into the cartridge mounting portion in an insertion direction which is aligned with a first direction, wherein the printing fluid cartridge comprises:

a cartridge body comprising a printing fluid chamber configured to store printing fluid therein;

a printing fluid supply portion provided at the cartridge body and extending along the first direction, wherein the printing fluid supply portion is in fluid communication with the printing fluid chamber;

an electric interface; and a support member comprising a support surface facing in a first sub direction and a rear surface positioned opposite the support surface and facing in a second sub direction opposite the first sub direction, wherein the first sub direction and the second sub direction constitute a second direction which is perpendicular to the first direction, wherein the electric interface is provided at the support surface, and the cartridge mounting portion comprises:

a connection portion configured to be connected to the printing fluid supply portion and allow the printing fluid to flow out of the printing fluid chamber through the printing fluid supply portion; and a sandwiching portion comprising a first sandwiching piece and a second sandwiching piece, wherein the first sandwiching piece and the second sandwiching piece are spaced away from each other in the second direction, and configured to sandwich, in the second direction, the support member of the printing fluid cartridge inserted into the cartridge mounting portion, wherein the first sandwiching piece comprises a surface facing in the second sub direction, wherein the surface of the first sandwiching piece supports a contact configured to contact the electric interface, one of the first sandwiching piece and second sandwiching piece comprises a guide surface configured to contact the support member and guide the support member in the second direction during insertion of the printing fluid cartridge into the cartridge mounting portion, and the cartridge body has a first space and a second space formed therein, wherein the first space is opened in the insertion direction and the first sandwiching piece is configured to be inserted into the first space, and the second space is opened in the insertion direction and the second sandwiching piece is configured to be inserted into the second space, wherein the support surface of the support member faces the first space and the rear surface of the support member faces the second space, wherein the cartridge body is configured to hold the support member such that the support member is movable relative to the cartridge body in the second direction.

2. The printing fluid supply device of claim 1, wherein the second sandwiching piece is positioned such that the second sandwiching piece overlaps the contact supported by the first sandwiching piece when the sandwiching portion is viewed in the second direction.

3. The printing fluid supply device of claim 1, wherein the cartridge body is configured to hold the support member such that the support member is movable relative to the cartridge body in the first direction, and the cartridge body comprises a range limiting portion configured to limit a range of movement of the support member relative to the cartridge body in the first direction.

4. The printing fluid supply device of claim 3, wherein the support member comprises ends in a third direction which is perpendicular to the first direction and the second direction, and the range limiting portion comprises a groove into which one of the ends of the support member is inserted and a first pair of wall surfaces defining ends of the groove in the first direction, wherein the range limiting portion is configured to limit the range of movement of the support member relative to the cartridge body in the first direction by the first pair of wall surfaces selectively contacting the support member in the first direction.

5. The printing fluid supply device of claim 4, wherein the range limiting portion comprises a second pair of wall surfaces defining ends of the groove in the second direction, and the range limiting portion is configured to limit a range of movement of the support member relative to the cartridge body in the second direction by the second pair of wall surfaces selectively contacting the support member in the second direction.

6. The printing fluid supply device claim 3, wherein the cartridge mounting portion further comprises a movement limiting portion configured to limit movement of the support member relative to the cartridge mounting portion in the insertion direction, and the range limiting portion is configured to resiliently expand, in a removal direction opposite the insertion direction, the range of movement of the support member relative to the cartridge body in the first direction when the movement limiting portion limits the movement of the support member in the insertion direction.

7. The printing fluid supply device of claim 6, wherein the movement limiting portion comprises a wall surface facing in the removal direction, and the wall surface of the movement limiting portion is positioned on a downstream side of the contact in the insertion direction, wherein the movement limiting portion is configured to limit the movement of the support member in the insertion direction by the wall surface of the movement limiting portion contacting the support member during the insertion of the printing fluid cartridge into the cartridge mounting portion.

8. The printing fluid supply device of claim 6, wherein the range limiting portion comprises a wall surface facing in the insertion direction and positioned on an upstream side of the support member in the insertion direction, and a resilient member supporting and biasing the wall surface in the insertion direction, and wherein the range limiting portion is configured to resiliently expand the range of movement of the support member in the removal direction by the wall surface of the range limiting portion contacting the support member and moving in the removal direction against a biasing force of the resilient member.

9. The printing fluid supply device of claim 1, wherein the cartridge body is configured to hold the support member such that the support member is movable relative to the cartridge body in a third direction perpendicular to the first direction and the second direction, and the printing fluid supply device comprises a positioning portion configured to position the support member relative to the cartridge mounting portion in the third direction, wherein the positioning portion comprises:

a guide portion provided at one of the support member and the cartridge mounting portion, wherein the guide portion comprises a third pair of wall surfaces spaced away from and facing each other in the third direction, and a space formed between the third pair of wall surfaces in the third direction has a distal end and a base end opposite the distal end in the first direction, wherein the distal end of the space between the third pair of wall surfaces is opened in the first direction toward the other of the support member and the cartridge mounting portion, and a distance of the third pair of wall surfaces in the third direction is more narrowed at a position closer to the base end than at a position closer to the distal end; and a guide objective portion provided at the other of the support member and the cartridge mounting portion and configured to move between and relative to the third pair of wall surfaces toward the base end during the insertion of the printing fluid cartridge into the cartridge mounting portion.

10. The printing fluid supply device of claim 1, wherein the printing fluid cartridge further comprises a first movable member configured to move between a first position in which the first movable member covers the support surface of the support member at the first space and a second position in which the first movable member is retracted from the first space such that the support surface is exposed to the first space, and the first sandwiching piece is configured to contact the first movable member and move the first movable member from the first position to the second position during the insertion of the printing fluid cartridge into the cartridge mounting portion.

11. The printing fluid supply device of claim 1, wherein the printing fluid cartridge further comprises a second movable member configured to move between a third position in which the second movable member covers the rear surface of the support member at the second space and a fourth position in which the second movable member is retracted from the second space such that the rear surface is exposed to the second space, and the second sandwiching piece is configured to contact the second movable member and move the second movable member from the third position to the fourth position during the insertion of the printing fluid cartridge into the cartridge mounting portion.

12. The printing fluid supply device of claim 1, wherein the printing fluid cartridge is configured to be inserted into the cartridge mounting portion with the second direction aligned with a gravitational direction which is a combination of an upward direction and a downward direction, wherein the first sub direction is the upward direction and the second sub direction is the downward direction, wherein the support surface of the support member faces in the upward direction of the gravitational direction, and the surface of the first sandwiching piece supporting the contact faces in the downward direction of the gravitational direction, wherein the second sandwiching piece is positioned below the first sandwiching piece in the gravitational direction and has an end in a removal direction opposite the insertion direction, wherein the second sandwiching piece comprises the guide surface at the end of the second sandwiching piece.

13. A printing fluid cartridge configured to be inserted into a cartridge mounting portion in an insertion direction which is aligned with a first direction, the cartridge mounting portion comprising a connection portion, a first sandwiching piece supporting a contact, and a second sandwiching piece, the cartridge comprising:

a cartridge body comprising a printing fluid chamber configured to store printing fluid therein;

a printing fluid supply portion provided at the cartridge body and extending along the first direction, wherein the printing fluid supply portion is configured to be connected to the connection portion, such that the printing fluid is allowed to flow out of the printing fluid chamber through the printing fluid supply portion;

an electric interface configured to contact the contact supported by the first sandwiching piece; and a support member comprising a support surface facing in a first sub direction and a rear surface positioned opposite the support surface and facing in a second sub direction opposite the first sub direction, wherein the first sub direction and the second sub direction constitute a second direction which is perpendicular to the first direction, wherein the electric interface is provided at the support surface, wherein the cartridge body has a first space and a second space formed therein, wherein the first space is opened in the insertion direction so as to receive the first sandwiching piece therein, and the second space is opened in the insertion direction so as to receiver the second sandwiching piece therein, wherein the support surface of the support member faces the first space and the rear surface of the support member faces the second space, wherein the cartridge body is configured to hold the support member such that the support member is movable relative to the cartridge body in the second direction.

14. The printing fluid cartridge of claim 13, wherein the cartridge body is configured such that the second space receives the second sandwiching piece up to a position which overlaps the electric interface when the second space is viewed in the second direction.

15. A printing fluid cartridge comprising:

a cartridge body comprising a printing fluid chamber configured to store printing fluid therein;

an electric interface;

a support member comprising a support surface facing in a first sub direction and a rear surface positioned opposite the support surface and facing in a second sub direction opposite the first sub direction, wherein the electric interface is provided at the support surface; and a printing fluid flow path having an end which is opened to the outside of the cartridge body, wherein the printing fluid flow path extends from the end of the printing fluid flow path in a third sub direction toward the interior of the cartridge body, wherein the printing fluid flow path is configured to allow the printing fluid out of the printing fluid chamber therethrough, wherein the cartridge body has a first space and a second space formed therein, wherein the first space is opened in a fourth sub direction opposite the third sub direction, and the second space is opened in the fourth sub direction, wherein the third sub direction and the fourth sub direction constitute a first direction and the first sub direction and the second sub direction constitute a second direction which is perpendicular to the first direction, wherein the support surface of the support member faces the first space and the rear surface of the support member faces the second space, wherein the cartridge body is configured to hold the support member such that the support member is movable relative to the cartridge body in the second direction.

16. The printing fluid cartridge of claim 15, wherein the cartridge body is configured such that the first space is accessible from the outside of the cartridge body along the third sub direction up to a position which overlaps the electric interface when the first space is viewed in the second direction, and the cartridge body is configured such that the second space is accessible from the outside of the cartridge body along the third sub direction up to a position which overlaps the electric interface when the second space is viewed in the second direction.

17. The printing fluid cartridge of claim 15, wherein the cartridge body is configured to hold the support member such that the support member is movable relative to the cartridge body in the first direction, and the cartridge body comprises a range limiting portion configured to limit a range of movement of the support member relative to the cartridge body in the first direction.

18. The printing fluid cartridge of claim 15, wherein the printing fluid cartridge further comprises a first movable member configured to move between a first position in which the first movable member covers the support surface of the support member at the first space and a second position in which the first movable member is retracted from the first space such that the support surface is exposed to the first space.

19. The printing fluid cartridge of claim 15, wherein the printing fluid cartridge further comprises a second movable member configured to move between a third position in which the second movable member covers the rear surface of the support member at the second space and a fourth position in which the second movable member is retracted from the second space such that the rear surface is exposed to the second space.

* * * * *